US007567163B2

(12) United States Patent
Dadafshar et al.

(10) Patent No.: US 7,567,163 B2
(45) Date of Patent: Jul. 28, 2009

(54) PRECISION INDUCTIVE DEVICES AND METHODS

(75) Inventors: Majid Dadafshar, Escondido, CA (US); Francisco Michel, San Diego, CA (US)

(73) Assignee: Pulse Engineering, Inc., San Diego, CA (US)

( * ) Notice: Subject to any disclaimer, the term of this patent is extended or adjusted under 35 U.S.C. 154(b) by 0 days.

(21) Appl. No.: 11/213,461

(22) Filed: Aug. 26, 2005

(65) Prior Publication Data

US 2006/0145800 A1 Jul. 6, 2006

Related U.S. Application Data

(60) Provisional application No. 60/606,330, filed on Aug. 31, 2004.

(51) Int. Cl.
*H01F 17/06* (2006.01)

(52) U.S. Cl. ..... 336/178

(58) Field of Classification Search ..... 336/65, 336/83, 178, 200, 212, 214–215, 232
See application file for complete search history.

(56) References Cited

U.S. PATENT DOCUMENTS

| | | | | |
|---|---|---|---|---|
| 1,767,715 | A | 6/1930 | Stoelke | |
| 3,068,436 | A | 12/1962 | Holmberg et al. | |
| 3,585,553 | A | 6/1971 | Muckelroy et al. | |
| 3,874,075 | A | 4/1975 | Lohse | |
| 4,352,081 | A | 9/1982 | Kijima | |
| 4,424,504 | A | 1/1984 | Mitsui et al. | |
| 4,538,132 | A | 8/1985 | Hiyama et al. | |
| 4,597,169 | A | 7/1986 | Chamberlin | |
| 4,760,366 | A | 7/1988 | Mitsui | |
| 5,003,279 | A | 3/1991 | Morinaga et al. | |
| 5,126,714 | A | 6/1992 | Johnson | |
| 5,204,653 | A * | 4/1993 | Saitoh et al. | 336/178 |
| 5,204,809 | A | 4/1993 | Andresen | |
| 5,243,308 | A | 9/1993 | Shusterman et al. | |
| 5,351,167 | A | 9/1994 | Wai et al. | |
| 5,381,124 | A | 1/1995 | Roshen | |
| 5,414,401 | A * | 5/1995 | Roshen et al. | 336/178 |

(Continued)

OTHER PUBLICATIONS

A Novel Modeling Concept for Multi-coupling Core Structures, Pit-Leong Wong, Fred C. Lee, Xiaochuan Jia and Daan van Wyk; Center for Power Electronics Systems, Virginia Polytechnic Institute and State University, Blacksburg, VA 24061, Jan. 2001, pp. 102-108.

(Continued)

*Primary Examiner*—Tuyen Nguyen
(74) *Attorney, Agent, or Firm*—Gazdzinski & Associates, PC

(57) ABSTRACT

A low cost, low profile, small size and high performance inductive device for use in, e.g., electronic circuits. In one exemplary embodiment, the device includes a ferrite core comprising multiple inductors and optimized for electrical and magnetic performance. Improvements in performance are obtained by, inter alia, control of the properties of the gap region(s) as well as placement of the windings relative to the gap. The magnetic path properties of the inductors at the ends of the device are also optionally controllable so as to provide precise matching of inductances. Optionally, the device is also self-leaded, thereby simplifying its installation and mating to a parent device (e.g., PCB). Methods for manufacturing and utilizing the device are also disclosed.

21 Claims, 14 Drawing Sheets

U.S. PATENT DOCUMENTS

| | | | | |
|---|---|---|---|---|
| 5,600,293 | A | 2/1997 | Hunter | |
| 5,764,500 | A | 6/1998 | Matos | |
| 6,005,467 | A | 12/1999 | Abramov | |
| 6,018,468 | A | 1/2000 | Archer et al. | |
| 6,060,977 | A * | 5/2000 | Yamamoto et al. | 336/212 |
| 6,087,920 | A | 7/2000 | Abramov | |
| 6,087,921 | A | 7/2000 | Morrison | |
| 6,223,419 | B1 | 5/2001 | Abramov | |
| 6,362,986 | B1 | 3/2002 | Schultz et al. | |
| 6,377,155 | B1 * | 4/2002 | Allen et al. | 336/200 |
| 6,483,409 | B1 | 11/2002 | Shikama et al. | |
| 6,825,643 | B2 | 11/2004 | Li et al. | |
| 7,280,025 | B2 * | 10/2007 | Sano | 336/200 |
| 2004/0113741 | A1 * | 6/2004 | Li et al. | 336/212 |
| 2004/0145445 | A1 * | 7/2004 | Yang | 336/223 |
| 2004/0207503 | A1 | 10/2004 | Flanders et al. | |
| 2004/0208027 | A1 | 10/2004 | Elek et al. | |
| 2005/0151614 | A1 | 7/2005 | Dadafshar | |

OTHER PUBLICATIONS

Investigating Coupling Inductors in the Interleaving QSW VRW, Pit-Leong, Qiaoqiao Wu, Peng Xu, Bo Yang and Fred C. Lee, Center for Power Electronics Systems, Virginia Polytechnic Institute and State University, Blacksburg, VA 24061, Mar. 2000, pp. 973-978.

* cited by examiner

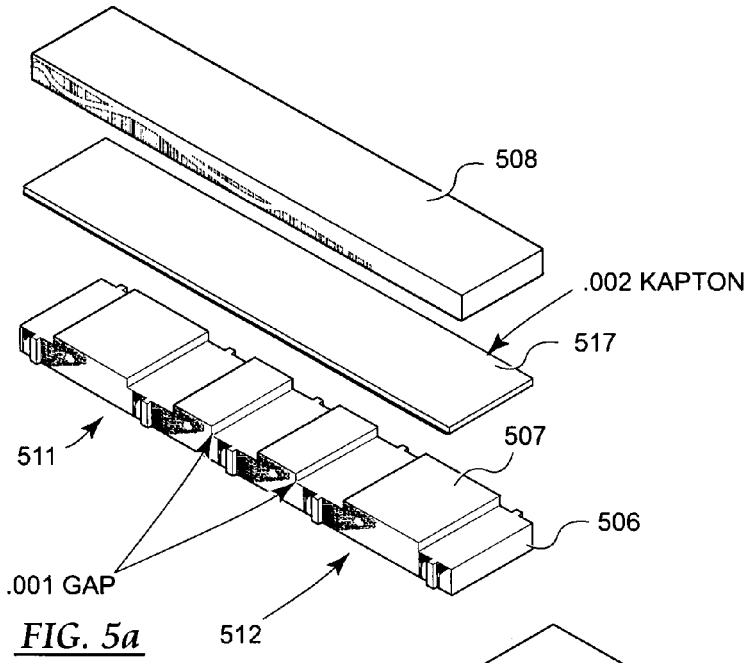
FIG. 5a
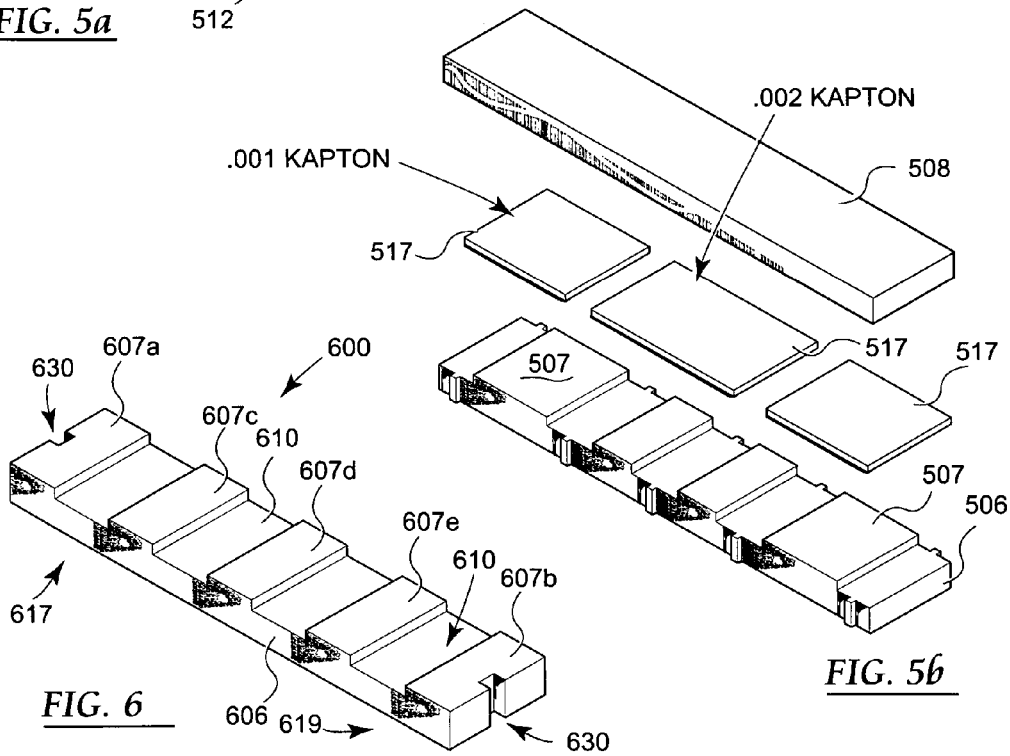
FIG. 6
FIG. 5b

PRECISION INDUCTIVE DEVICES AND METHODS

PRIORITY AND RELATED APPLICATIONS

This application claims priority to U.S. Provisional Patent Application Ser. No. 60/606,330 filed Aug. 31, 2004 of the same title, which is incorporated herein by reference in its entirety. This application is generally related to the subject matter of U.S. patent application Ser. No. 10/990,915 filed Nov. 16, 2004 entitled "IMPROVED INDUCTIVE DEVICES AND METHODS", which claims priority to U.S. Provisional Application Ser. No. 60/520,965 filed Nov. 17, 2003 of the same title, both incorporated herein by reference in their entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

1. Field of the Invention

The present invention relates generally to inductive circuit elements and more particularly to inductive devices having various desirable electrical and/or mechanical properties, and methods of operating and manufacturing the same.

2. Description of Related Technology

Myriad different configurations of inductors and inductive devices are known in the prior art. See, for example, U.S. Pat. No. 1,767,715 to Stoekle, U.S. Pat. No. 3,068,436 to Holmberg, et al, U.S. Pat. No. 3,585,553 to Muckelroy et al., U.S. Pat. No. 3,874,075 to Lohse, which represent various approaches to providing inductances within a circuit.

Still other configurations are known. For example, U.S. Pat. No. 4,352,081 to Kijima issued Sep. 28, 1982 entitled "Compact trans core" discloses a compact core for a transformer wherein the central leg of the core is either trapezoidal or triangular in cross-section and wherein the two side legs of the transformer core are triangular in cross-section. The selection of a trapezoidal or triangular central core leg and triangular side legs significantly reduces the overall dimensions of the transformer by constructing the side legs of the core so as to protrude into the space which would normally be immediately above or below the side legs of an E-E or E-I transformer.

U.S. Pat. No. 4,424,504 to Mitsui, et al. issued Jan. 3, 1984 entitled "Ferrite core" discloses a ferrite core for the use of a power transformer and/or a choke coil. The core is assembled by a pair of identical core halves, and each core half comprises (a) a circular center boss, (b) a pair of outer walls positioned at both the sides of said boss for mounting a coil, and (c) a pair of base plates coupling said center boss and said outer walls.

U.S. Pat. No. 4,597,169 to Chamberlin issued Jul. 1, 1986 entitled "Method of manufacturing a turnable microinductor" discloses a microcoil having a winding on a composite core made up of a portion of substantially magnetic material and a portion of substantially non-magnetic material. The winding is split so that a part of the magnetic material core portion is exposed, and a laser is used to remove material from the exposed part of the magnetic core portion. The inductance of the coil is measured during the removal of the magnetic material, and the inductance of the coil is trimmed to a desired value through the removal of an appropriate amount of magnetic material. The non-magnetic core portion serves as a support structure for the portions of the winding on the core even if a substantial portion of the magnetic material is removed.

U.S. Pat. No. 4,760,366 to Mitsui issued Jul. 26, 1988 entitled "Ferrite core" discloses a ferrite core for the use of a power transformer and/or a choke coil with small size. The core is assembled by a pair of identical core halves together with a bobbin wound a coil. Each of the core halves has an E-shaped structure with a center core on which a coil is wound, a pair of side legs and a base plate which couples the center core with the side legs. The cross section of the center core is not circular nor rectangular, but is flat having rectangular portion with a first side and a second side and a pair of arcs coupled with said first side.

U.S. Pat. No. 5,003,279 to Morinaga, et al. issued Mar. 26, 1991 entitled "Chip-type coil" discloses a chip-type coil whose terminal electrodes are formed directly on a magnetic core and each comprise a mixture of electrically conductive material with insulating material, so that specific resistance of the terminal electrode can increase so as to reduce an eddy current flowing in the terminal electrode, thereby limiting Q-deterioration in the chip-type coil.

U.S. Pat. No. 5,204,809 to Andresen issued Apr. 20, 1993 entitled "H-driver DC-to-DC converter utilizing mutual inductance" discloses a DC-to-DC converter that uses an H-bridge driver to alternately energize first and second inductors. By alternately energizing the first and second inductors, a higher switching frequency can be maintained allowing for the use of smaller inductors while reducing ripple in the output voltage. The reduced ripple in turn reduces the need for filtering. Additionally, the first and second inductors are wound about a common core such that a mutual inductance exists therebetween. The mutual inductance results in trapezoidal currents in each inductor instead of the typical sawtooth waveforms. This results in lower ripple in the output voltage.

U.S. Pat. No. 5,243,308 to Shusterman, et al. issued Sep. 7, 1993 entitled "Combined differential-mode and common-mode noise filter" discloses an electromagnetic noise filter having a plurality of U-shaped wires passing through a ferrite core. Some of the wires are singly fitted in throughholes, whereas other wires are commonly fitted in throughholes. The wires can be interconnected to provide for impedance to both differential-mode and common-mode noise.

U.S. Pat. No. 5,351,167 to Wai, et al. issued Sep. 27, 1994 entitled "Self-leaded surface mounted rod inductor" discloses an electronic component adapted for surface mounting on a PC board has an elongate bobbin made of a dielectric material. A coil of wire is wound about the winding support surface of the bobbin. The coil has a pair of lead terminations which are wrapped around a pair of T-shaped lead termination support members extending from the same side of the bobbin. When the bobbin rests on top of a PC board, the support members position the wrapped lead terminations slightly above solder pads.

U.S. Pat. No. 5,764,500 to Matos issued Jun. 9, 1998 entitled "Switching power supply" discloses a switching power supply using a transformer having a first primary winding and a second primary winding wrapped around the same core but wrapped around opposite sides of the core. One of the ends from each of a pair of secondary windings are electrically connected together to form a conventional transformer center tap and the remaining ends of the secondaries become conventional transformer end taps.

U.S. Pat. No. 6,005,467 to Abramov issued Dec. 21, 1999 entitled "Trimmable inductor" discloses a trimmable inductor, comprises a supporting substrate having spaced apart lead terminals, a coil defined by an electrically conductive member mounted on the substrate in a continuous path of multiple turns forming a winding about an axis and extending between the lead terminals, and an electric conductive shorting member extending and electrically connected between one or more turns and a terminal of the coil to enable selective inclusion and elimination of at least part of one of the turns of the coil.

U.S. Pat. No. 6,018,468 to Archer, et al. issued Jan. 25, 2000 entitled "Multi-resonant DC-to-DC converter" discloses a DC-to-DC converter, comprising: inverter means for receiving a DC input and providing as an output a high-frequency, alternately pulsed current waveform; a control winding for receiving the output of the inverter means, the control winding being wound on a common bobbin with first and second tank windings, the windings de-coupled on the bobbin so that there is a significant leakage inductance between the windings, the first and second tank windings having two discrete resonant frequencies on a common core and flux path, a main primary winding wound in series with the control winding, the main primary winding being wound onto a separate bobbin and residing on its own core leg and flux path, first and second secondary windings coupled with the main primary winding, the first and second secondary windings being wound out of phase with each other, the first and second secondary windings feeding, respectively, first and second diodes, the first and second diodes rectifying the alternately pulse current waveform generated by high-frequency operation of the inverter means.

U.S. Pat. No. 6,087,920 to Abramov issued Jul. 11, 2000 entitled "Monolithic inductor" discloses a monolithic inductor comprises an elongated substrate having opposite distal ends and, each end having an end cap extending from the opposite ends to support the substrate in spaced relation from a PC board, the end caps being formed with non-mounting areas and a deflection area for preventing the substrate resting on the non-mounting area, a substantially steep side wall on the substrate side of the end cap at the non-mounting area, and an inclined ramp extending up to a top of the end cap on the substrate side substantially opposite the non-mounting area, an electrically conductive soldering band extending partially around each end cap, each soldering band having a gap at the non-mounting area for thereby reducing parasitic conduction in the band, and an electrically conductive layer formed on the substrate in a helical path extending between the opposite ends and in electrical contact with the conductive soldering bands at the ramps. See also U.S. Pat. No. 6,223,419.

U.S. Pat. No. 6,087,921 to Morrison issued Jul. 11, 2000 entitled "Placement insensitive monolithic inductor and method of manufacturing same" discloses a monolithic inductor comprises an elongated substrate having opposite distal ends and, each end having an end cap extending radially from the respective end to support the substrate in spaced relation from a PC board, each end cap having a plurality of intersecting planar surfaces defining corners, an electrically conductive layer forming a winding on the substrate and extending between the opposite ends to provide a winding, and an electrically conductive soldering pad extending partially around at least some of the corners of said end caps at each end of the substrate in electrical contact with the conductive layer, each soldering pad providing a terminal on each of the intersecting planar surfaces.

U.S. Pat. No. 6,362,986 to Schultz, et al. issued Mar. 26, 2002 entitled "Voltage converter with coupled inductive windings, and associated methods" discloses a DC-to-DC converter that generates an output voltage from an input voltage. The converter includes first and second inductive windings and a magnetic core. One end of the first winding is switched at about 180 degrees out of phase with one end of the second winding, between ground and the input voltage. The first winding is wound about the core in a first orientation, and the second winding is also wound about the core in the first orientation so as to increase coupling between windings and to reduce ripple current in the windings and other parts of the circuit. This version is a buck converter—versions that form boost, buck-boost and other converters are also provided. The invention also provides a multi-phase DC-to-DC converter for providing an output voltage from an input voltage. The converter has N ($N \geqq 2$) inductive windings alternatively switched, again in the buck-converter version, between ground and the input voltage. Again, boost, buck-boost, or other versions are also provided. Each of the N windings has a turn-on switching transition separated in switching phase by at least about 360/N degrees from any other of the windings. Each of the windings also has a turn-off switching transition separated in phase by at least about 360/N degrees from any other of the windings. Each of the N windings is wound about the core in like orientation to increase coupling between windings and to reduce ripple current in the windings and other parts of the circuit. The invention also provides suitable core structures.

U.S. Pat. No. 6,483,409 to Shikama, et al. issued Nov. 19, 2002 entitled "Bead inductor" discloses a bead-type inductor which is constructed so as to be mass produced includes a substantially rectangular-parallelepiped core. The core includes an axial portion and an outer peripheral portion, and a coil is formed by winding a metal wire around the axial portion. The axial portion includes a central portion and a peripheral portion. A high strength material is used for the central portion. Metal caps are disposed on both ends of the core. The caps and the coil are connected electrically. In addition, the central portion of the axial portion may be a cavity.

U.S. Pat. No. 6,825,643 to Li, et al. issued Nov. 30, 2004 entitled "Power converter module with an electromagnetically coupled inductor for switch control of a rectifier" discloses a power converter module including a wave generator, a rectifier, and a switch controller. The rectifier includes first and second power switches, and an LC circuit. The switch controller is coupled electrically to the wave generator and control terminals of the first and second power switches, and includes a control coil coupled electromagnetically to an inductor coil of the LC circuit. The switch controller can turn the first power switch on and off periodically in response to a periodic output of the wave generator, and can ensure that the second power switch is turned off when the first power switch is turned on, and that the second power switch is turned on when the first power switch is turned off.

United States Patent Publication No. 20040207503 to Flanders, et al. published Oct. 21, 2004 entitled "Self-damped inductor" discloses an inductor with self-damping properties for use in multiple applications including for high power broadband frequency applications. The inductor comprises a coil having an input end and an output end and wound about a core of magnetically permeable material and an eddy current generator incorporated either at the time of manufacture or post manufacturing. The core can be air (e.g., a hollow coil of wire). Alternative core materials are iron, iron powder, steel laminations and other appropriate materials. The core may be incorporated into some form of frame whether I shaped, U shaped, E shaped or of an encapsulated shape arrangement. The inductor's Q value may be changed selectively by deliberately inducing eddy currents in preferred locations. The eddy currents are induced into the inductors and have the effect of introducing a back EMF which is designed and scaled appropriately to adjust the Q value at the desired frequency resulting is less phase distortion.

U.S. Patent Application Publication No. 20040208027 to Elek, et al. published Oct. 21, 2004 entitled "Power system with coupled inductor" discloses an inductive coupler comprises a first coil defining a first outer periphery and a second coil defining a second outer periphery. A metal member extends around the first and second outer peripheries of the first and second coils forming a conductive loop.

See also "A Novel Modeling Concept for Multi-coupling Core Structures", Pit-Leong Wong, Fred C. Lee, Xiaochuan Jia and Daan van Wyk; Center for Power Electronics Systems, Virginia Polytechnic Institute and State University, Blacksburg, Va. 24061, January 2001, and "Investigating Coupling Inductors in the Interleaving QSW VRW", Pit-Leong, Qiaoqiao Wu, Peng Xu, Bo Yang and Fred C. Lee, Center for Power Electronics Systems, Virginia Polytechnic Institute and State University, Blacksburg, Va. 24061, March 2000, both incorporated herein by reference in their entirety.

Despite the foregoing broad variety of prior art inductor configurations, there is a distinct lack of a simplified and low-cost, high performance inductor configuration that provides a high degree of uniformity (tolerance) as well as great precision. This high tolerance is often desirable for electronic circuit elements, especially were two or more such components are disposed in a common circuit. Typical prior art inductive device used in such applications are discrete components which may or may not have high tolerance. Even so-called "coupled" prior art solutions lack substantial uniformity in the inductances and other performance attributes of the individual constituent inductors.

Hence, there is a need for an improved multi-inductor device that substantially eliminates variations between the individual inductors, and allows for a great degree of electrical precision. Such improved device would ideally utilize a common core (so as to reduce variations induced by differing materials, process and dimensions that are typically associated with discrete devices, and would also allow for shaping or control of the magnetic flux paths in individual ones of the inductors so as to permit as precise a balancing of the individual inductances as possible. Such device would also optionally mitigate the effects of eddy currents induced by winding placement near the core gap(s).

SUMMARY OF THE INVENTION

The present invention satisfies the foregoing needs by providing an improved precision inductive device (including coupled inductors).

In a first aspect of the invention, an improved high-precision inductive device is disclosed. In one embodiment, the device comprises a unitary core element having windings and a plurality of risers corresponding to individual inductors. A top core piece or cap provides magnetic coupling (i.e., a pathway) for each riser. Use of a common core with a unitary base element provides significantly enhanced inductance tolerance and electrical performance. Use of a "residue gap" between the core element and cap allows for precise control of the properties of each inductor. In another embodiment, placement of the gap away from the windings is used to reduce interaction between the magnetic flux of the gap and the windings, thereby increasing performance. Advantageously, the residue gap and winding placement may also be used in the same device, thereby further enhancing performance (including for example AC ripple reduction).

In another embodiment, a coupled inductor device is disclosed which comprises a plurality of inductors formed in a side-by-side disposition within a core having first and second ends and a cap element, two of the inductors being disposed on respective ones of the first and second ends, the two end inductors having different magnetic path characteristics than the others of the plurality of inductors so as to cause all of the plurality of inductors within the device to have substantially identical inductance values.

In a second aspect of the invention, an improved multi-inductor device is disclosed. In one embodiment, the inductors are arranged in a linear disposition within a core, with the two inductors on the ends of the core having different magnetic path characteristics than the other inductors. In one variant, the different characteristic(s) comprise a different gap cross-sectional area (A), which alters the reluctance and accordingly raises the inductance of these two end devices. This allows mitigation of flux leakage effects on the two end inductors, and accordingly better balance between the inductance values of all inductors in the device.

In a third aspect of the invention, an improved method of controlling the operation of a multi-inductor device is disclosed. In one embodiment, the method comprises creating a residue gap between at least two portions of a magnetically permeable core used in the device. The residue gap allows for precise control of the properties of each individual inductor, and hence better balancing of inductance across the device as a whole.

In a fourth aspect of the invention, an improved method of controlling the operation of a multi-inductor device is disclosed. In one embodiment, the method comprises disposing the gap relative to the windings during manufacture in order to mitigate the interaction between the gap flux and the windings, thereby reducing eddy current and other potentially deleterious effects.

In a fifth aspect of the invention, an improved method of controlling the operation of a multi-inductor device is disclosed. In one embodiment, the method comprises controlling one or more parameters associated with the magnetic pathways for one or more of the inductors in order to more evenly balance the inductance of all the devices. In one variant, the act of controlling comprises setting the gap cross-sectional area for the two "end" inductors of the device, thereby reducing reluctance (R) and allowing for an increased inductance of the end inductors.

In a sixth aspect of the invention, a method of manufacturing an inductor device is disclosed. In one embodiment, the inductor comprises a coupled inductor, and the method comprises: providing at least one magnetically permeable core element having a plurality of risers; providing a magnetically permeable cap element; preparing at least one of a mating surface of the risers and a mating surface of the cap element to provide a desired surface property; providing a plurality of windings; mating the windings with the core element; and mating the core element and the cap element.

BRIEF DESCRIPTION OF THE DRAWINGS

The features, objectives, and advantages of the invention will become more apparent from the detailed description set forth below when taken in conjunction with the drawings, wherein:

FIGS. 1*i*-1*l* illustrate alternate variants of the device of FIG. 1*a*.

FIG. 5*a* is a top perspective exploded view of one various components of another exemplary embodiment of the inductive device of the present invention, wherein heterogeneous risers are utilized.

FIG. 5*b* is a top perspective exploded view of one various components of another exemplary embodiment of the inductive device of the present invention, wherein both heterogeneous risers and differential gap sizes are utilized FIG. 6 is a top perspective view of another exemplary embodiment of the core element of the inductive device of the invention, wherein an "E" type end configuration is used.

DETAILED DESCRIPTION OF THE INVENTION

Figure 1A:
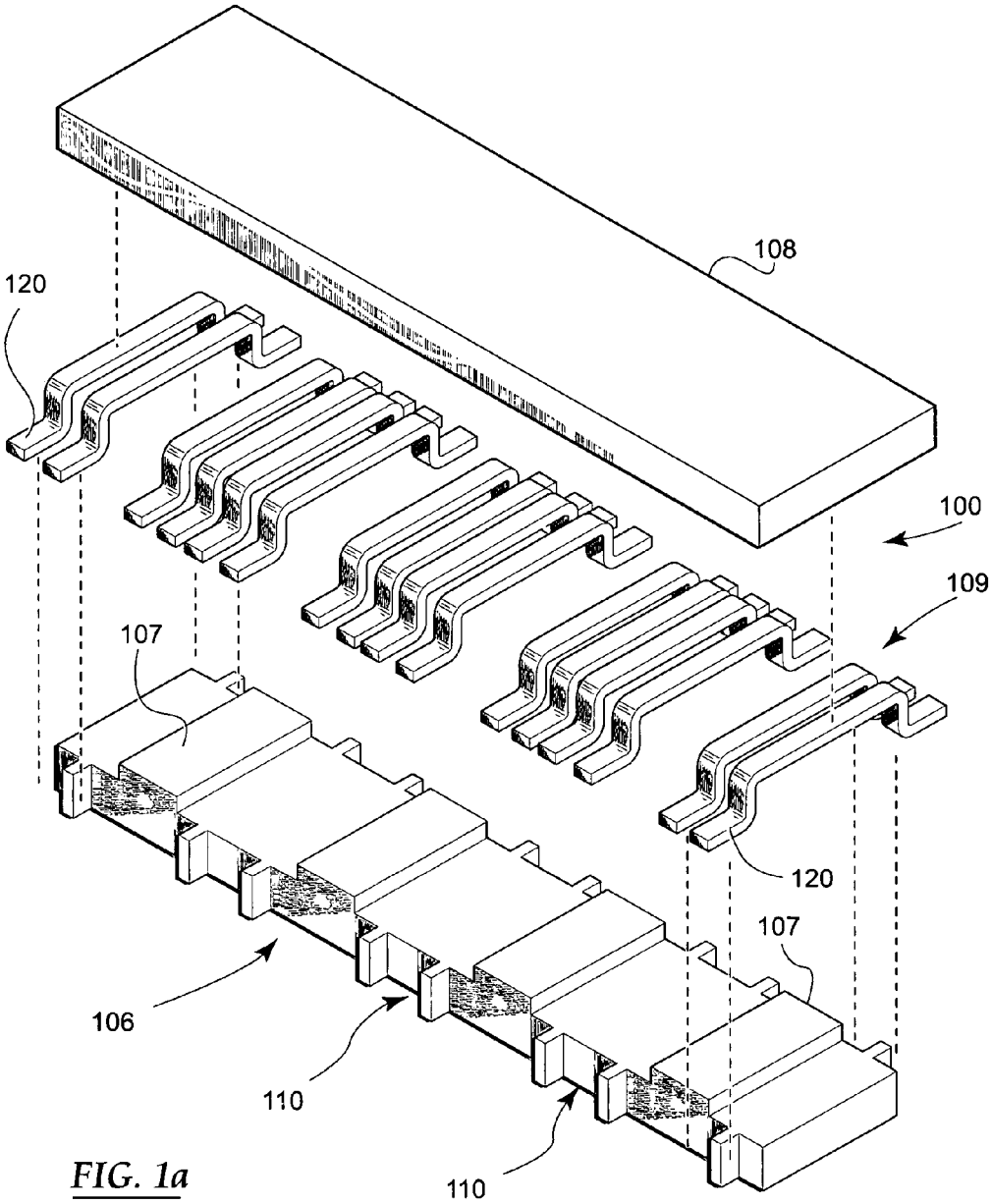
FIG. 1*a* is a top perspective exploded view of one exemplary embodiment of the improved inductive device of the present invention.
Figure 1B:
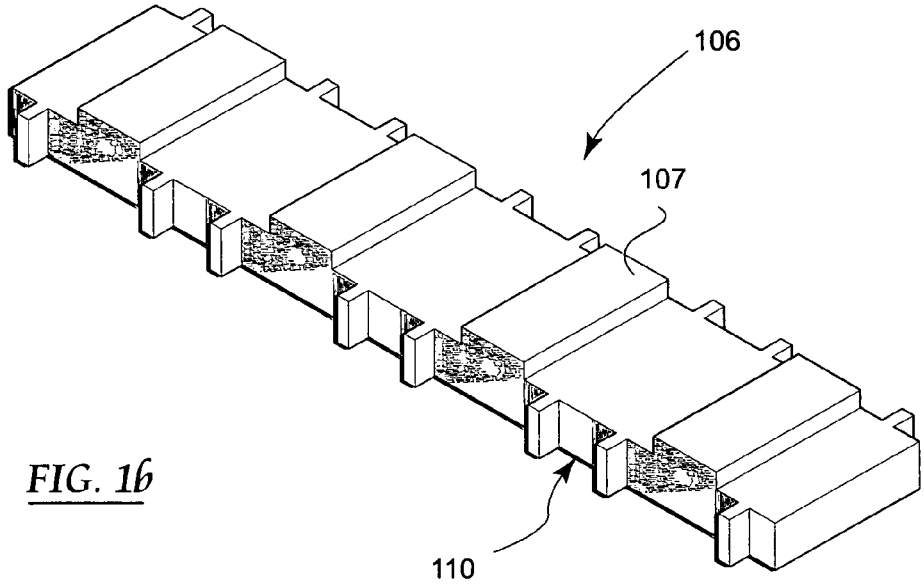
FIG. 1*b* is a top perspective view of one exemplary embodiment of a central core element used in the inductive device of FIG. 1*a*.
Figure 1C:
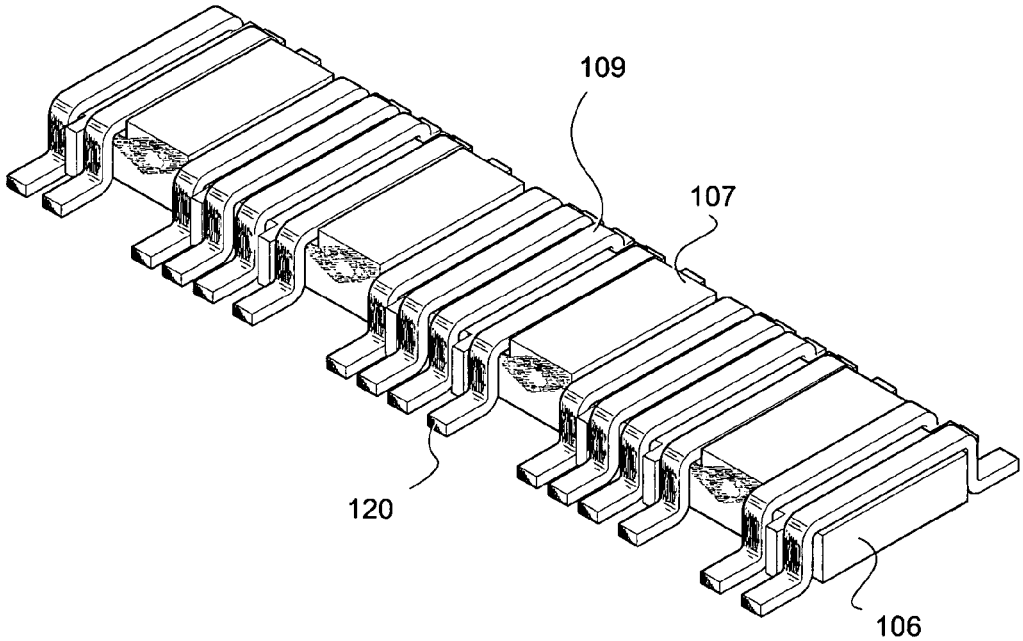
FIG. 1*c* is a top perspective view of the device of FIG. 1*a* shown partially assembled.
Figure 1D:
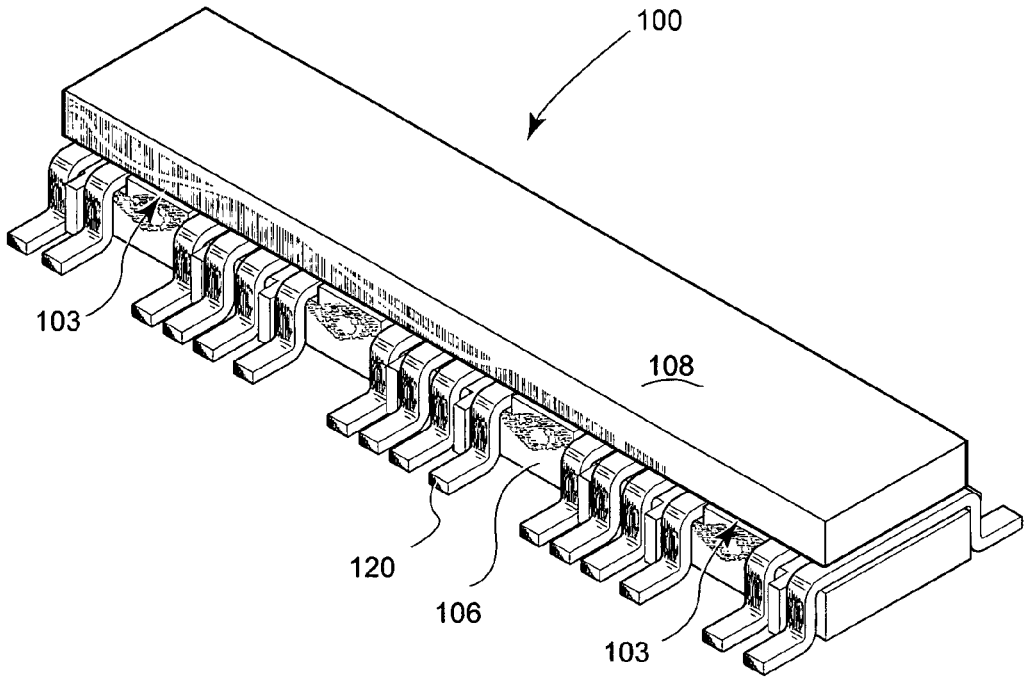
FIG. 1*d* is a top perspective view of the device of FIG. 1*a* shown fully assembled.

Reference is now made to the drawings wherein like numerals refer to like parts throughout.

As used herein, the term "magnetically permeable" refers to any number of materials commonly used for forming inductive cores or similar components, including without limitation various formulations made from ferrite.

As used herein, the term "winding" refers to any type of conductor, irrespective of shape, cross-section, or number of turns, which is adapted to carry electrical current.

Overview

The present invention provides, inter alia, improved inductive apparatus and methods for manufacturing and utilizing the same.

As is well, known, a high degree of uniformity (tolerance) is often desirable for electronic circuit elements, especially were two or more such components are disposed in a common circuit. For example, in power supply applications, the recent trend has been to distribute current or load associated with components in the power supply across multiple similar components, such as replacing one 100 A inductor with four (4) 25 A inductors. This technique of distribution, however, also requires a high degree of uniformity or tolerance between the e.g., four devices; otherwise, additional components (such as a sense resistor) may be required, thereby adding additional cost and labor.

Typical prior art inductive device used in such applications are discrete components which may or may not have high tolerance. For example, different cores having slightly different material compositions, dimensions, thermal properties, shrinkage, etc. may be used, thereby causing each of the four devices in the aforementioned example to have slightly different inductance values.

Alternatively, prior are multi-inductor devices and coupled inductor devices attempt to combine multiple discrete devices into a common core, yet do not adequately address the differences between the individual devices (and hence the variation in their inductances and other magnetic properties).

The present invention is advantageously adapted to overcome these disabilities of the prior art by (i) providing a common core configuration which eliminates many of the potential differences between the inductance values of the devices; (ii) utilizing core and winding configurations which are particularly adapted to mitigate the effects of magnetic flux across the inductor gap; and (iii) using a gapping technology which allows very precise control of the inductor gap.

Stated in another fashion, the techniques of the present invention permit an increased level of uniformity and precision in the inductor magnetic properties which is not achievable using prior art techniques; this increased uniformity and precision accordingly allows for enhanced electrical performance as compared to that achievable using such prior art techniques. In practical terms, this means that each inductive device produced according to the present invention can be made smaller, thereby making it more space efficient and less costly to manufacture.

In one salient aspect, the inductive devices of the present invention provide enhanced electrical performance through precise control of one or more features of their design and manufacture. These features include inter alia, use of a so-called "residue" or micro-gap in one or more inductors of the core which eliminates many of the disabilities associated with prior art "macro" gap approaches.

Another feature of the present invention comprises the careful placement of windings relative to the core and gap of each inductor in order to mitigate the deleterious effects of interaction between the core gap flux and the windings.

EXEMPLARY EMBODIMENTS

Referring now to FIGS. 1*a*-1*d*, a first exemplary embodiment of the present invention is described in detail. It will be recognized that while the following discussion is cast in terms of an inductor, the invention may be applied to other types of inductive devices (e.g., transformers).

FIGS. 1*a*-1*d* show a first embodiment of an inductive device 100 comprising a "common" or unitary core forming a plurality of inductors 101. FIG. 1*a* shows an exploded perspective view of the exemplary device 100 which generally comprises a device core 102 having a central core element 106 with a plurality of risers 107, and a corresponding top core piece 108. A gap 103 is formed between the central core element 106 and risers 107, as described in greater detail below. It will be recognized that the terms "top" and "central" as used herein have no particular implication for placement; i.e., the device 100 can be inverted such that the "top" piece is below the central core element 106, and so forth. The central core 106 generally comprises a substantially planar bottom face, while the top face 105 is irregular and includes the risers 107. The height, cross-sectional area, and profile of the central core 106 and risers 107 can be adjusted as desired (discussed in greater detail below) in order to provide the desired electrical properties; hence, the rectangular shape shown is merely illustrative.

The device 100 further comprises a plurality of windings 109 which are, in the illustrated embodiment, alloy or copper-based conductive strips of a predetermined length and thickness which are deformed in order to fit within respective channels 110 formed in the central core 106. The material, width, thickness, and other properties of the windings are selected so as to provide a minimum of electrical resistance and hence heating, although other performance attributes may be considered in their design. Other possible materials include without limitation silver, gold or Palladium or alloys thereof; however, these materials add significant cost to the device. The windings 109 may also be plated (e.g., with tin) or coated as desired, such as with an oxidation-resistant coating or even an insulator over a portion of their length. The windings 109 are disposed (one each) on each of the channels 110 in a wrap-around fashion (FIG. 1*c*), such that at least a portion (pads 120) of the windings 109 are disposed proximate to the underside 118 of the device central core 106. This approach advantageously allows for self-leading, described below, wherein the pads 120 of the windings 109 comprise, inter alia, mounting points for electrically connecting the device 100 to the parent PCB or other device. As such, the pads 120 may be electrically connected to the parent PCB in any number of ways well known in the art (e.g. solder joints, direct forced physical contact, bonding, etc.). Furthermore, different types of pad and winding structures may be used with the device as is well known in the electronic arts, including without limitation terminal pins, balls, and surface mount (i.e., "L" shaped) leads; see, e.g., the embodiment of FIGS. 2-4 described subsequently herein.

It will further be recognized that the windings 109 and conductive pads may be actually formed onto the central core 106 itself, such as for example where the windings are coated or plated onto the surface of the core 106 (not shown), such as within channels 110 formed within the core. The conductive windings 109 can also feasibly be sprayed on as well, i.e., as a thin layer of conductive material on the surface of the core element 106. Myriad other approaches to providing conductive traces on one or more surfaces of the core 102 may be used consistent with the invention, all such variants being readily implemented by those of ordinary skill provided the present disclosure.

Furthermore, it will be appreciated that the various windings may be made heterogeneous in, e.g., inductance, thickness, height, interface configuration (i.e., pin, SMT, etc.), and/or material. Myriad different variations of these different parameters are possible in order to produce a device with the desired qualities.

The central core 106 is, in the illustrated embodiment, formed directly as shown (e.g., in a mold or form of the type well known in the art), or alternatively machined from a block to have the desired features and number of risers 107, e.g., either one, two, three, four, etc. Hence, using the latter approach, a common block can be used as the basis for multiple different designs, and no special (expensive) additional tooling is required. For example, where a device is destined to have two risers 107, a core 106 that can accommodate up to say four inductors or risers) can be used, with the additional portion of the core "blank" simply machined off before assembly. Notwithstanding the foregoing, it will be appreciated that the core of the present invention can feasibly be made to have any number of risers including even and odd numbers, and may be hybridized in any number of facets including combined use of stepped and non-stepped risers 107, use of varying thickness windings 109, non-symmetric geometries, etc. Various "stepped" gap configurations are described in co-pending and co-owned U.S. provisional application No. 60/520,965 entitled "Improved Inductive Devices and Method" filed Nov. 17, 2003, and incorporated herein by reference in its entirety, although other approaches may be used. Furthermore, a "stacked" approach such as that described in co-owned and co-pending U.S. provisional application No. 60/600,985 entitled "Stacked Inductive Device and Methods of Manufacturing filed Aug. 12, 2004 and incorporated herein by reference in its entirety, can be used consistent with the present invention, such as for example where a second central core 106 is stacked atop the first, the bottom surface of the second acting in effect as the top core piece 108, and so forth.

Additionally, the size and geometry of the central core element 106 can be varied depending on the operation of the inductors $L_l$-$L_n$. For example, where all magnetic currents within the core are additive in the center element 106, a larger cross-section element may be used. Alternatively, where the currents are destructive or "buck", a smaller element may be used. Also, the risers 107 can have a different cross-sectional shape (and even taper), such as for example circular, elliptical, hexagonal, triangular, etc., and may be sized differently as described in greater detail subsequently herein.

The device 100 may also be externally shielded if desired using any one of myriad well-known shielding technologies available in the art (such as tin plating or use of a wrap-around Faraday shield).

A key feature of the illustrated embodiment of FIGS. 1*a*-1*d* relates to the use of a novel "micro" or residue gap approach. Under prior art techniques, the inductor gap is treated as a "macro" feature of the inductor; i.e., a gap specification of "X mils" or the like is provided, and the device constructed to this specification within +/−tolerance. However, at such small gap sizes, the tolerance associated with available gap formation techniques (e.g., micro-cutting/sawing or formation of the gap at time of core formation) can cause significant variations from one core element to another, between individual inductors (gaps) on the same multi-inductor device, or even within different portions of the same gap. The less precise the gap, the more potential variation of the inductive properties (especially across a unified device having multiple inductors therein). This variation increases the disparity between the inductance values (H) of the individual inductors within such a unified device, and accordingly reduces the level of performance achievable by the design (since even a fractional percent change in inductance can have a significant effect on currents associated with each of the individual inductors).

In contrast, embodiments of the present invention utilize a "micro" approach to core gapping, also herein referred to as "residue gap". Specifically, little or no "macro" gap as previously described exists; rather, the surface texture of the two opposing gap faces is used to provide what effectively comprises an array of micro-gaps. Since the gapping dynamics are dictated at the micro level, they can be more precisely controlled, resulting in significantly less disparity in the inductance of each device in a common core arrangement. Specifically, through proper selection of one or more parameters associated with the materials used to form the core, and/or the polishing (or lack thereof) of the critical gap surfaces, the uniformity of the individual inductors within the device is increased, and accordingly the inductances more evenly balanced, hence also improving the efficiency of the device. This aspect is significant for reducing well known AC "ripple" effect, which is a primary performance and design criteria for such devices in many electronic applications.

Figure 1E:
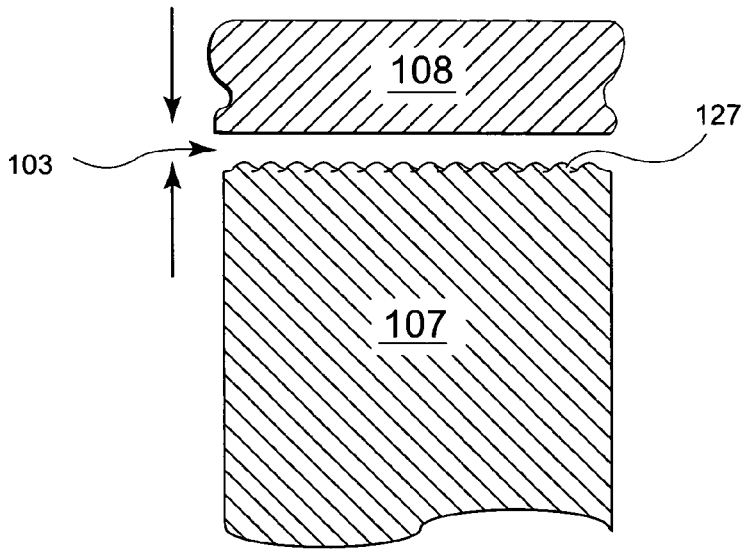
FIGS. 1*e* and 1*f* are side elevational views of various configurations of residue gap used in the inductive devices of the present invention.
Figure 1F:
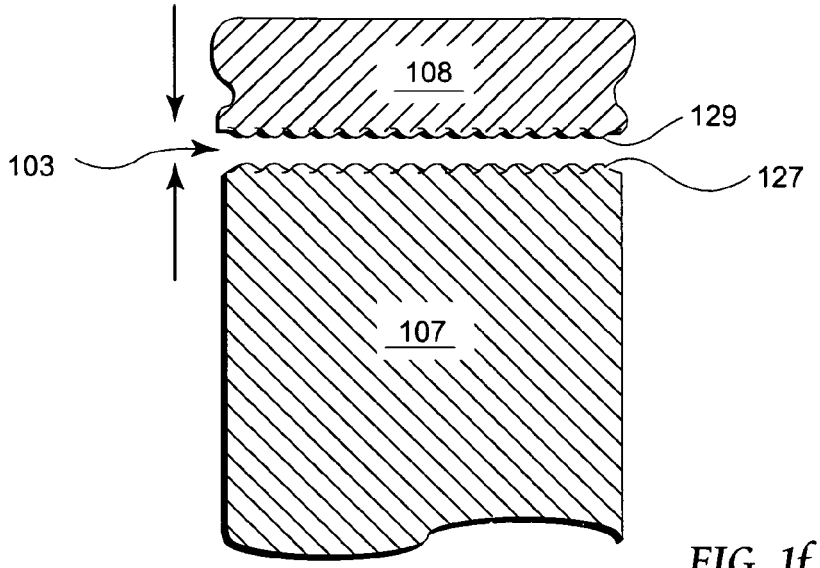

In one embodiment, a microscopically coarse surface is used on at least one surface 127 of the gap 103 (FIG. 1*e*) to provide the desired properties. In another embodiment, both sides 127, 129 of the gap 103 are made "coarse" or otherwise textured (FIG. 1*f*).

One parameter that is controllable to effect residue gap is the coarseness or grain-size of the constituent materials of the core material (e.g., ferrite). Larger grain size will result in a generally rougher gap surface. Another related parameter that can be controlled is the uniformity of the grain size. The broader the distribution in grain size, typically the less precise of the control of the residue gap. Hence, for many applications, an ideal grain configuration is one where all of the grains of one or more constituent materials are effectively identical, thereby resulting in a very uniform surface at the gap (subject to the macro formation techniques with which the core components are made).

Similarly, the uniformity of dispersion of constituent materials can be controlled to provide enhanced performance. Specifically, in one embodiment, the dispersion or mixing of the various core materials is made as uniform as possible in order to make the magnetic properties within each "micro" portion of the gap as uniform as possible.

The polishing (or lack of polishing) can be selectively employed to produce the desired residue gap as well. For example, may conventional ferrite cores are surface polished after formation, including gap regions. Such polishing can be used to establish a desired level of residue (correlating generally to the coarseness or roughness of the gap surface(s)).

Alternatively, since the polishing process can under certain circumstances cause slight or imperceptible surface asymmetries due largely to the polishing mechanism used; e.g., such as where polishing a raised flat surface having four corners such as the risers 107 of the device 100 of FIG. 1*a* causes slight wearing-down of the corners as compared to the center of the riser gap surface. Such asymmetries result in less precise gap control, and hence reduced electrical performance.

It will be appreciated that various levels of coarseness or granularity (whether controlled by material selection, the formation process used, or the polishing/finishing process used), as well as uniformity and dispersion, may be employed within the inductive device 100 to create the desired effects. Furthermore, multiple "grades" of residue gap may be used in the same device 100, or even within the same gap. For example, in one variant, a first grade or degree of residue gap is formed within a first portion of a given gap (e.g., 50% of the total gap area for that specific gap), while a second grade of residue gap is formed in a second portion. The different grades of residue may take on various shapes (e.g., side-by-side rectangles, concentric rings, etc.). One way for forming such different grades within the same gap is by simply polishing or not polishing certain regions to different degrees. More sophisticated approaches include controlling the material constituencies/properties in different regions of the gap, such as by using a smaller grain size in one region as opposed to another. Other approaches apparent to those of ordinary skill in the materials arts will be recognized provided the present disclosure.

Hence, the present invention contemplates both homogeneous and heterogeneous gap configurations, both on an inter-gap and intra-gap basis.

The residue of the gap may also be formed through use of the application of a coating of a similar or different material formed over the top of the relevant portions of the riser(s) 107 and/or top core piece 108. For example, in one variant, a micro-film ferrite having different residue properties than that used to form the core pieces 106, 108 themselves is deposited on one or both surfaces of the gap 103. Still other approaches will be recognized by those of ordinary skill provided the present disclosure.

Figure 1G:
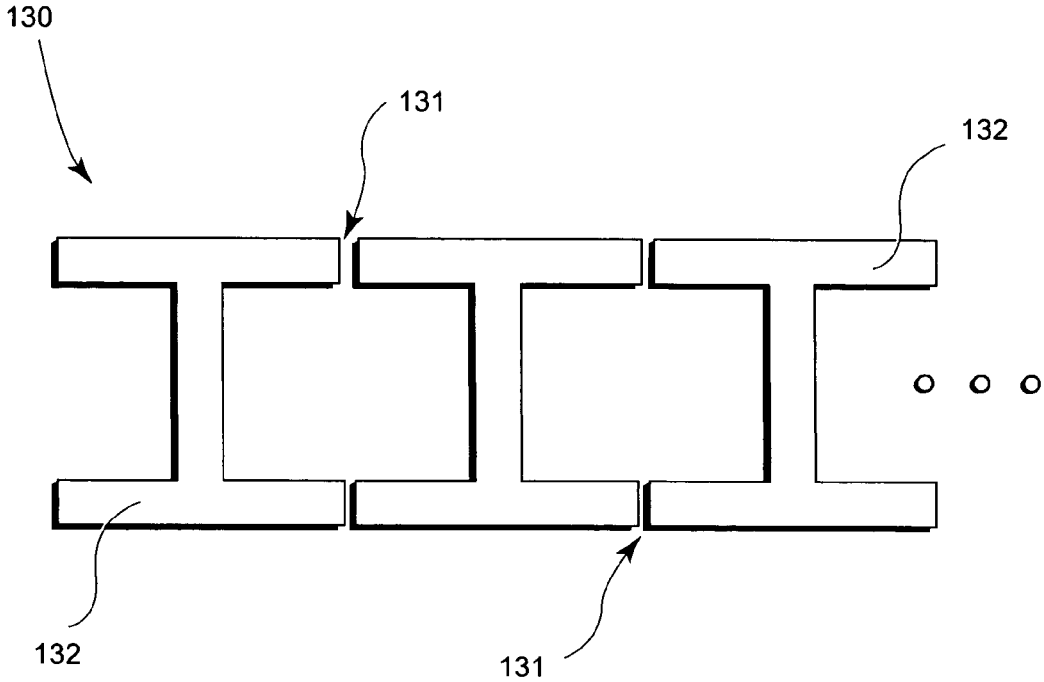
FIG. 1g (PRIOR ART)
FIG. 1*g* is a front view of a typical prior art "H" type multi-inductor device.

It will also be recognized that the present invention overcomes the disabilities associated with prior art "H" shaped inductors (FIG. 1*g*), particularly with respect to variations in the gaps 131 between individual H-elements 132 of the multi-inductor device 130. By using a common central core element 106 as shown in FIG. 1*a*, the present invention allows for a much greater degree of gap uniformity, and hence a higher inductance, and the attendant benefits associated therewith as described elsewhere herein. See, e.g., U.S. Pat. No. 6,362,986 to Schultz, et al. issued Mar. 26, 2002 and entitled "Voltage converter with coupled inductive windings, and associated methods" incorporated herein by reference in its entirety and previously described herein, which is typical of the prior art in this regard.

Figure 1H:
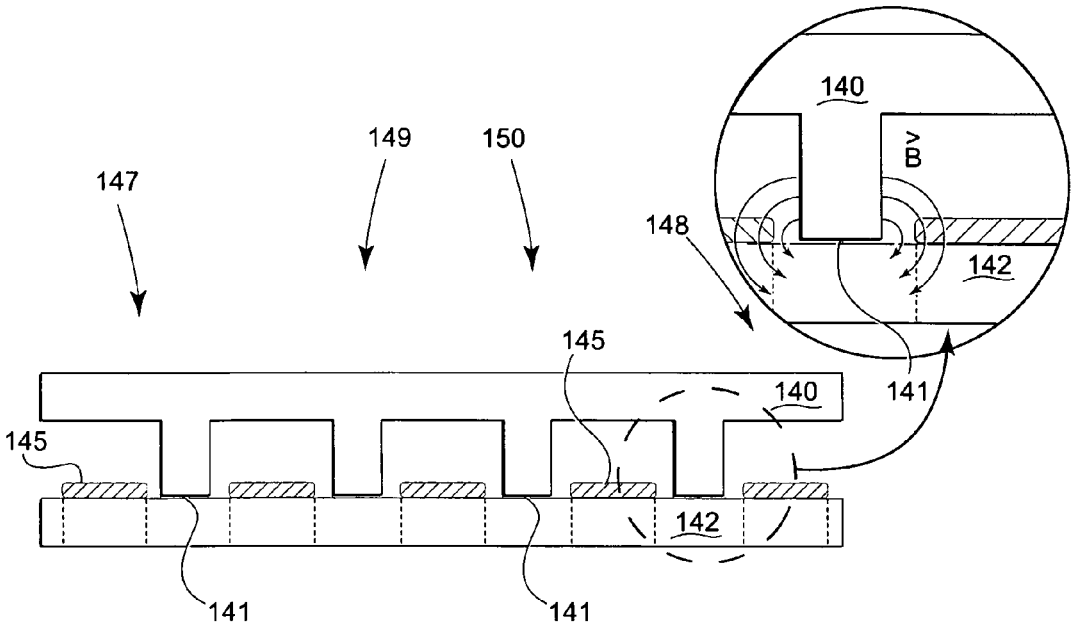
FIG. 1h (PRIOR ART)
FIG. 1*h* illustrates a typical prior art multi-inductor device configuration showing non-optimized winding placement with respect to the inductor gap(s).
Figure 1I:
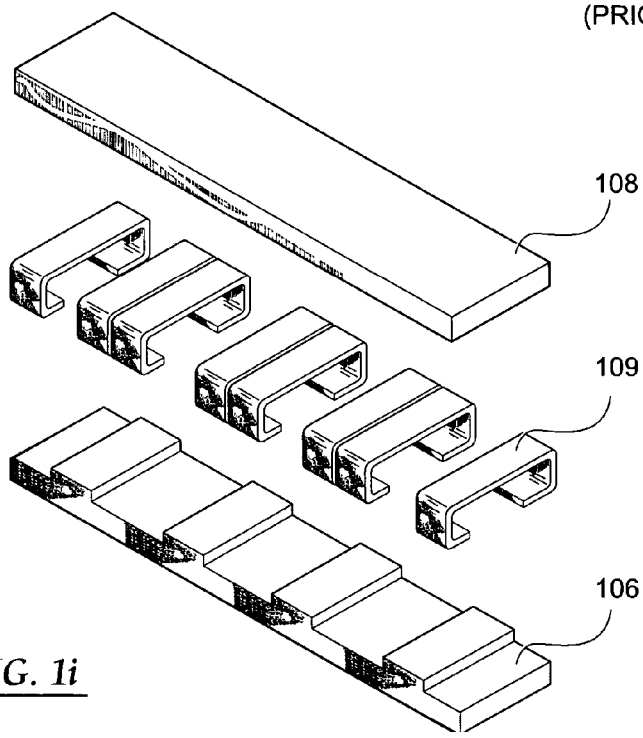
Figure 1J:
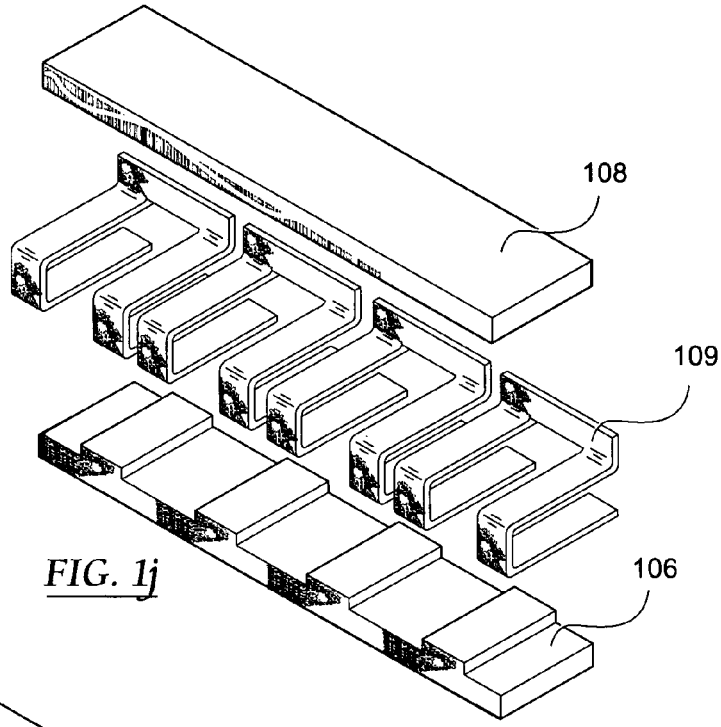
Figure 1K:
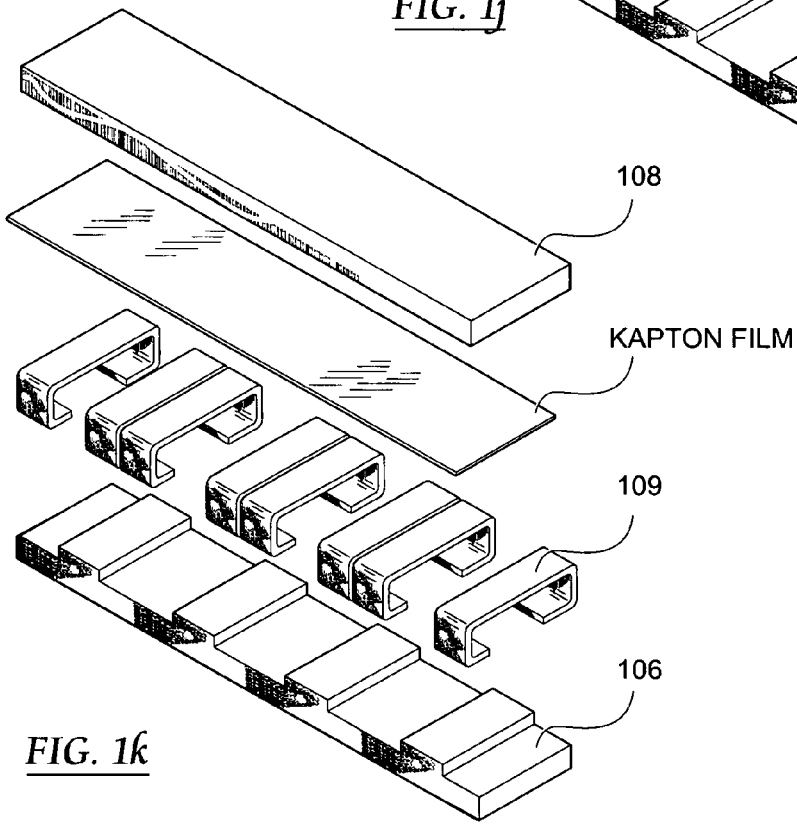
Figure 1F:
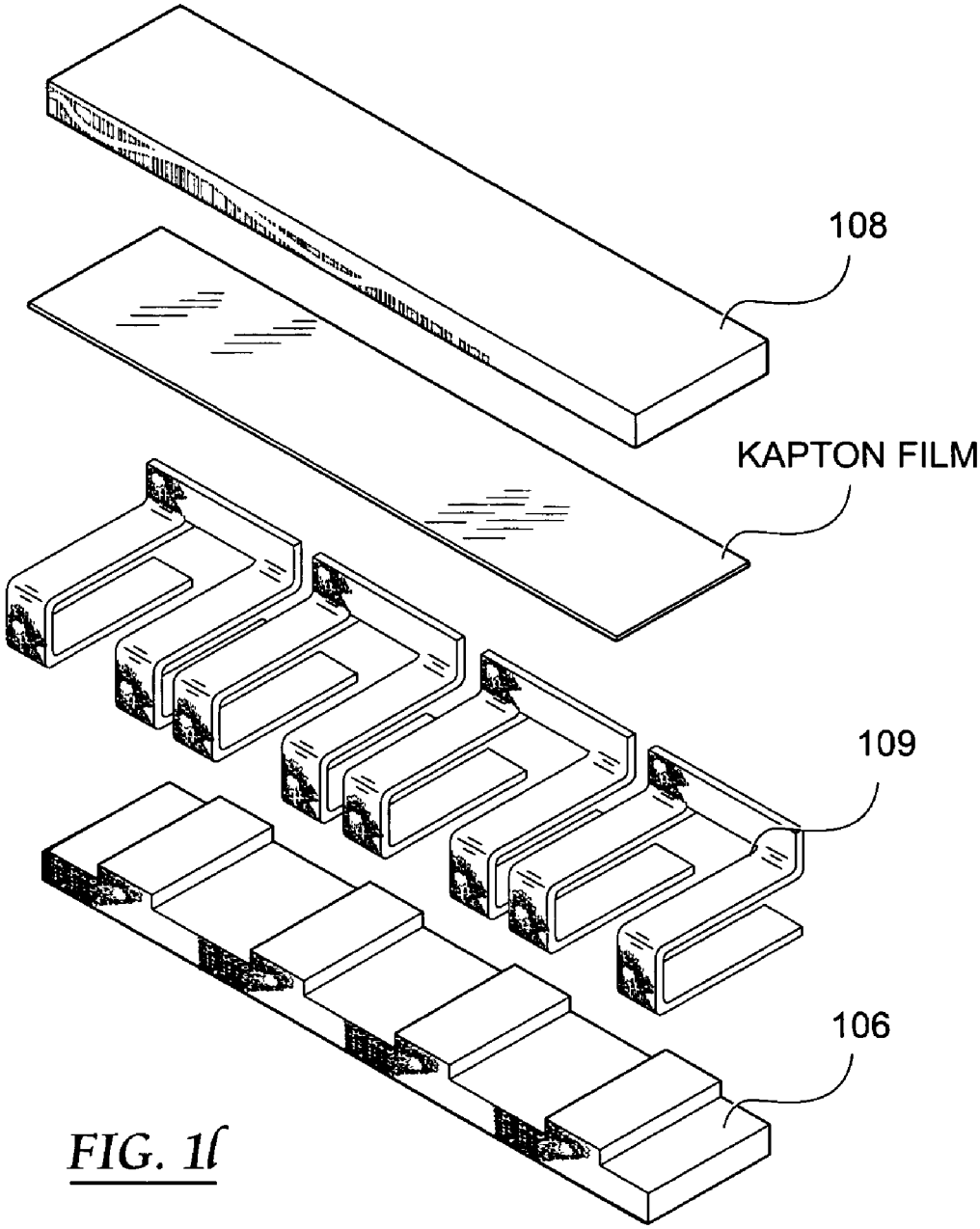

In another aspect of the invention, strategic placement of the windings of each inductor 101 of the device 100 is used to further improve performance of the composite inductor as a whole. Specifically, as shown in FIG. 1*h* (somewhat exaggerated for clarity), the prior art techniques place the windings (turns) 145 of each inductor immediately proximate to the gap 141 formed between the two core pieces 140, 142. As is well known, the magnetic flux lines permeating the gap region are distorted outward spatially from the gap to some degree, and hence intersect any conductors in immediate proximity to the gap. As the proximity of the conductor to the gap (for the same size gap) is reduced, so is the interaction of the magnetic flux with that conductor. These flux line intersections generate small (e.g., eddy) currents within the conductors near the gap, thereby causing reduced electrical efficiency and increased thermal effect within the conductors. This effect becomes more acute at higher AC frequencies, thereby causing progressively larger performance degradation as the frequency of the application is increased. To compensate, a larger inductor is required, thereby increasing size, footprint and cost factors of the device.

Conversely, by placing the windings 109 away from the gap 103 (and its associated flux lines) as in the embodiment of FIG. 1*a*, significantly less interaction between the flux lines and the windings occurs, thereby reducing the eddy current and thermal effects. This allows the use of smaller conductors (since the thermal and eddy current effects are reduced at the same primary current level) and hence smaller devices. In a multi-inductor device such as that of FIG. 1*a*, the disparity between inductance values for each individual device is also reduced, thereby providing further size reduction benefits for the same electrical performance. For example, in the four-inductor prior art device of FIG. 1*h*, the inductance values associated with the end inductors 147, 148 are significantly lower (due to, e.g., flux leakage out the "open" ends of the device) than the two interior inductors 149, 150. However, using the techniques of the present invention, the inductance values of the inner and outer inductors can be more closely balanced, thereby allowing for smaller and more precise devices.

In the embodiment of FIG. 1*a*, the gaps 103 formed between the central core element 106 and the top core piece 108 are disposed well above the plane 114 of the conductors (windings) 109, thereby reducing the field interaction between the gap and windings. It will be appreciated, however, that other geometries may be used which dispose the gap at least some distance from the nearest windings. For example, the gap 103 can be further recessed into the first core element (for the same total device height h 119) if desired, thereby moving the gap even further away from the windings 109.

While the aforementioned features of residue gap and gap positioning with respect to the winding are used within the same device 100 of FIG. 1*a*, it will be recognized that each feature can be used in isolation if desired. For example, the device 100 may utilize the residue gap as described, yet without the displacement between the gap and windings. However, it will be appreciated that the best performance will typically by achieved through use of both techniques.

As described above, the windings 109 (and the device 100 as a whole) are self-leaded. In this context, the term "self-leaded" refers to the fact that separate terminals electrically connecting the windings 109 to corresponding pads on the PCB or parent device, are not needed. One advantage of having self-leaded windings is to minimize the component count and complexity of the device 100, as well as increasing its reliability.

When the assembled device 100 is disposed on the parent device (e.g., PCB), the contact pads 120 of the windings are situated proximate to the PCB contacts pads, thereby facilitating direct bonding thereto (such as via a solder process). This feature obviates not only structures within the device 100, but also additional steps during placement on the PCB.

In yet another alternative, the free ends of the windings 109 are deformed around the underside of the core 106, thereby reducing device footprint. Hence, the core 106 is slightly elevated off the PCB or parent device by approximately the thickness of the winding ends disposed between the core underside and the top surface of the PCB.

In terms of maintaining the physical integrity of the assembled device 100 once assembled, various approaches may be used. In one variant, end-clips (e.g., plastic or another low-cost yet high strength material) are used to simply sandwich the central and top core pieces 106, 108 together, thereby capturing the windings 109 and any other components therein. In another variant, a thin and uniform layer of adhesive is disposed in one or more of the gap regions to hold the top core piece 108 to the central core 106. The presence of this material does not appreciably impact the magnetic properties of the gap. Similarly, a thin sheet of Kapton or other such material may be used to bond the two core components together, such as be heating the assembly to a temperature sufficient to melt the Kapton to each of the surfaces it is in contact with. Still other approaches for maintaining the integrity of the assembled device may be used consistent with the invention, as will be recognized by those of ordinary skill.

FIGS. 1*i*-1*l* illustrate yet additional variants on the general theme of the device of FIG. 1*a*. Here, different winding configurations are illustrated (including the "wrap-under" windings previously referenced with respect to FIG. 1*a*, as well as the use of an insulating sheet between the windings (and central core element) and the core top piece.

Figure 2A:
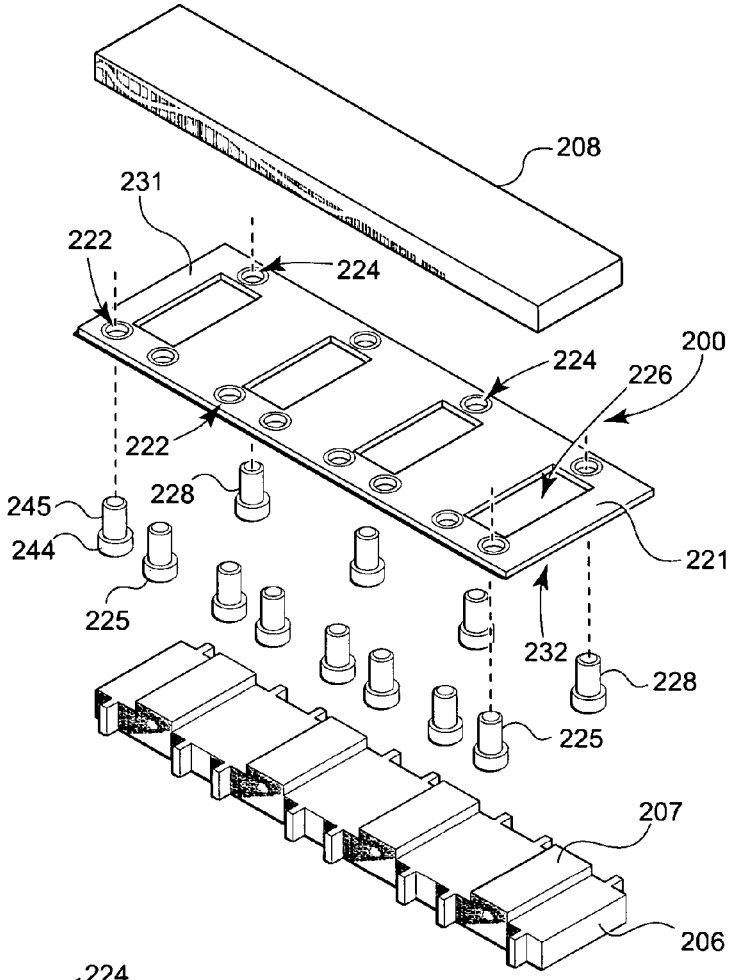
FIG. 2*a* is a top perspective exploded view of another exemplary embodiment of the improved inductive device of the present invention, utilizing a substrate and terminal approach.
Figure 2B:
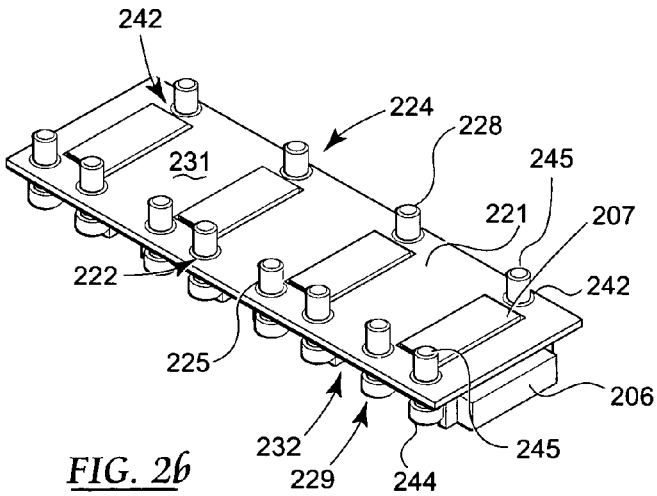
FIG. 2*b* is a top perspective view of the device of FIG. 2*a* shown partially assembled.
Figure 2C:
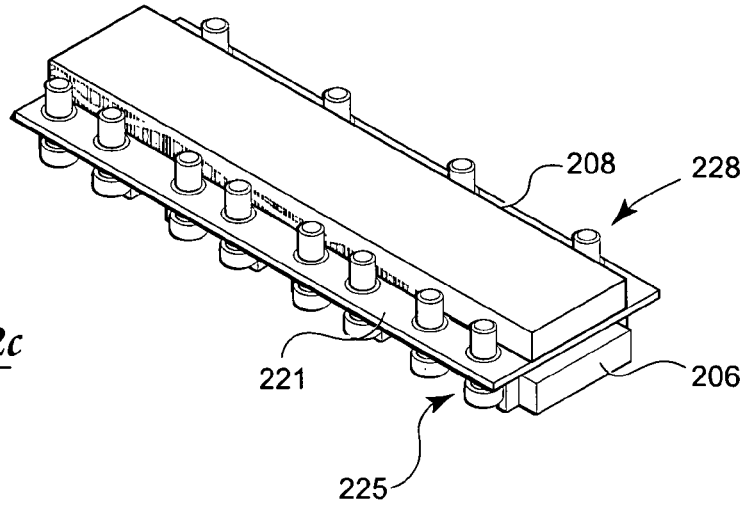
FIG. 2*c* is a top perspective view of the device of FIG. 2*a* shown fully assembled.

FIGS. 2*a*-2*c* show another exemplary embodiment of the improved inductive device 200 of the present invention, adapted for surface mounting such as on a PCB. As shown, the device 200 includes a central core element 206 and top piece 208, yet instead of the discrete windings of the embodiment of FIG. 1*a*, the device 200 uses a common substrate 221 disposed generally between the core elements 206, 208. This substrate may comprise a single or multi-layered PCB, although other configurations may also be used. The substrate 221 of FIG. 2 includes a plurality of sleeved terminal apertures 222, 224 as well as core riser apertures 226. The first terminal apertures 222 receive terminal pins 225 (described below) which connect electrically to winding traces 227 disposed on the surface (or even within the thickness) of the substrate 221. These winding patterns in the illustrated embodiment circle generally around the riser apertures 226, although other paths can be selected depending on desired interaction with the various core elements.

The second terminal apertures 224 receive "dummy" terminals 228 which do not have any electrical function, but rather are purely for balance and mechanical stability (planarity). As can be appreciated, embodiments of the device 200 with only the winding terminals and apertures 222 on one side of the device 200 would be mechanically unstable or sit angled on the PCB in all situations except where the height of the terminal pin bottom face 229 was coplanar with the bottom of the core element 206 (or otherwise adjusted for contact pad height or other artifacts on the parent PCB). This would result in significant restrictions on the application of the device 200, as well as imposing significant tolerance limits on the planarity of these terminals 225. However, by using the dummy terminals 228 as in the illustrated embodiment, a much broader range of applications (including both those where the core 206 sits on the PCB, or is elevated off the PCB by the terminals 225, 228) is made accessible. Furthermore, the use of variable height terminals 225, 228 allows the manufacturing process to accommodate slight variations in the planarity of the device core 206, the substrate 221, and even the parent PCB or device. As a simple example, consider where the core element 206 is bowed upward somewhat and hence not perfectly planar. The planarity of the core may not be critical, but if the contact surfaces of the terminals 225, 228 are not planar, then significant issues may arise when mating the device 200 to the parent PCB (assuming the latter to be perfectly planar for sake of illustration). Rather, by adjusting the terminal position within each aperture 222, 224 properly, the bottom surfaces of each terminal 225, 228 can be perfectly coplanar even when the device 200 is not.

Similarly, and more commonly, the substrate 221 is not perfectly planar, and hence the aforementioned ability to adjust terminal height within the substrate can readily account for such deficiencies as well.

The winding traces may comprise a copper alloy trace or any other conductive trace as is known to those of ordinary skill. The traces may also be disposed on both the top surface 231 and the bottom surface 232 of the substrate 221 if desired;

however, as discussed above with respect to FIG. 1*a*, it is typically desirable to dispose the traces on the bottom surface 232 of the substrate in order to mitigate interaction between the magnetic flux pathways of the gap and the windings. It will also be appreciated that the material of the substrate 221 (or layers or portions thereof) may be selected so as to further mitigate interaction between the gap flux lines and the windings, such as through use of material which diverts the flux lines away from the windings, or otherwise shields the windings in this regard.

As shown in FIG. 2*a*, the terminal pins 225, 228 comprises metallic or alloy conductive pins with a head 244 and contact surface 229, and shaft 245. The shaft 245 is received within the apertures 222, 224 of the substrate 221 as shown. This may be a frictional or interference fit if desired, and/or the pin shaft 245 may also be tapered or otherwise shaped (e.g., notched) so as to interface differentially or progressively with the aperture sleeve 242. The sleeves 242 comprise conductive material similar to the traces as well, although it will be recognized that these sleeves may be obviated in favor of another bonding approach (such as where the terminals are interference fit into the apertures and held by an adhesive, with a subsequent eutectic bead formed which connects to the winding traces previously described. A variety of different approaches to interfacing the terminals 225, 228 to the winding traces on the substrate 221 will be recognized by those of ordinary skill provided the present disclosure.

It will also be recognized that the configuration of the terminals 225, 228 need not be a headed "pin" as shown, but rather may take on any number of different forms with proper adaptation of the substrate 221. For example, the terminals might comprise terminal clips which clip or mate onto conductive portions of the substrate 221. As another alternative, pins (with no head 244) can be used to form in effect a pin-grid array (PGA).

Figure 2D:
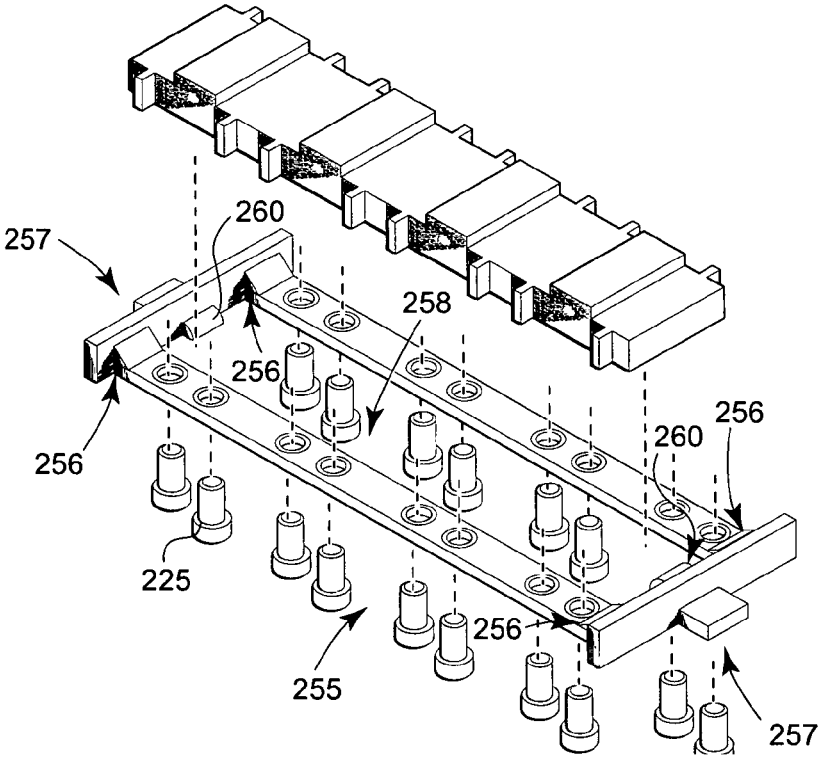
FIG. 2*d* is a top perspective view of another exemplary embodiment of the inductive device of the present invention, wherein a breakaway terminal holder is utilized.

In another variant of the device 250, a break-away pin holder or leadframe 255 can be used (see FIG. 2*d*) to aid in placement of the pins 225, 228. As shown in FIG. 2*d*, the holder 255 comprises a plastic molded frame which is scored 256 near its ends 257 so that it may subsequently be broken into multiple parts. The holder 255 allows the pins 225, 228 to be inserted therein (such as using press-fit or adhesive) and pre-aligned for subsequent mating of the terminals with the substrate 221. When the device 250 is assembled, the substrate 221 and the holder 255 are installed, with the bottom core element 206 optionally being held within a central aperture 258 of the frame 255 in order to maintain a predefined or constant relationship there between. In one embodiment, the core 206 is frictionally received within the frame 255 and aligned using two alignment features 260 formed on the frame 255 which cooperate with the core 206 to position the latter properly. Other approaches of aligning and retaining the core within the frame 255 may be used with equal success.

The foregoing relationship between the holder 255 and the core 206 effectively dictates a predetermined relationship between the holder 255 (and its terminals 225, 228) and the substrate 221 as well, since the relationship between substrate 221 and core 206 is predetermined. Hence, the holder 255 allows the substrate and terminals to be pre-positioned relative to one another during assembly such that the electrical and mechanical joint between the substrate (e.g., the aperture sleeves) and the terminals can be formed. In one embodiment, these joints comprise a eutectic solder of the type ubiquitous in the art, although other approaches (including interference fit with adhesive, etc.) may be substituted. Once the joints are formed, the break-away portions 257 of the frame 255 can be removed, thereby leaving the side regions 261 of the frame 255 in place, and the terminals securely bonded to the substrate 221.

Figure 3A:
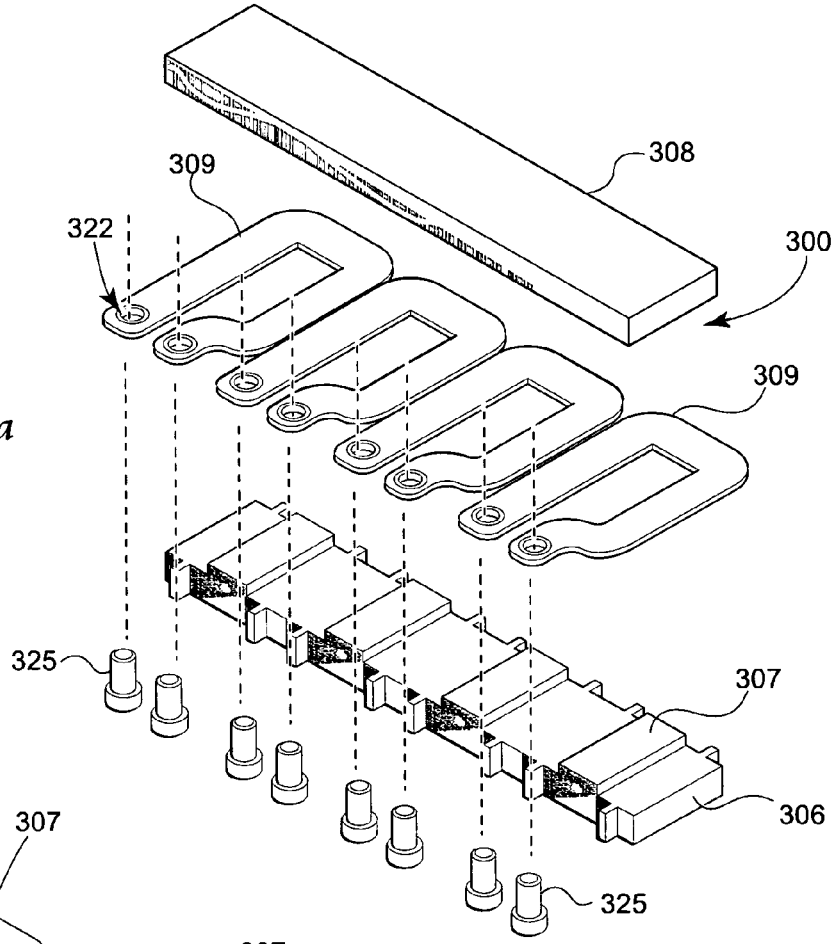
FIG. 3*a* is a top perspective exploded view of yet another exemplary embodiment of the improved inductive device of the present invention, utilizing winding "loops".
Figure 3B:
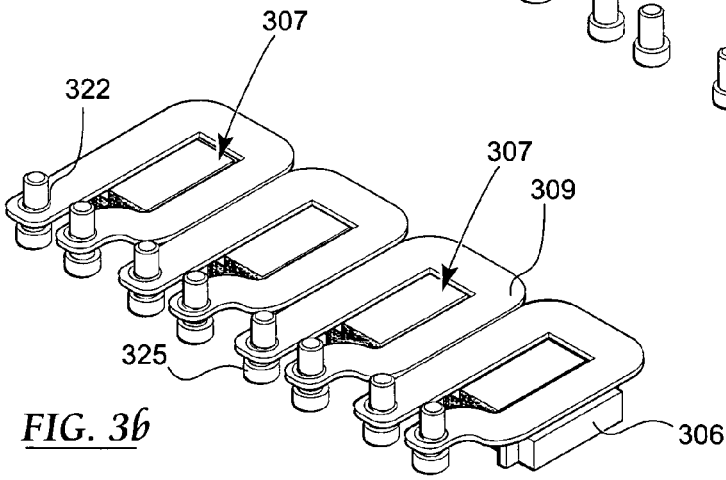
FIG. 3*b* is a top perspective view of the device of FIG. 3*a* shown partially assembled.
Figures 3C, 4A:
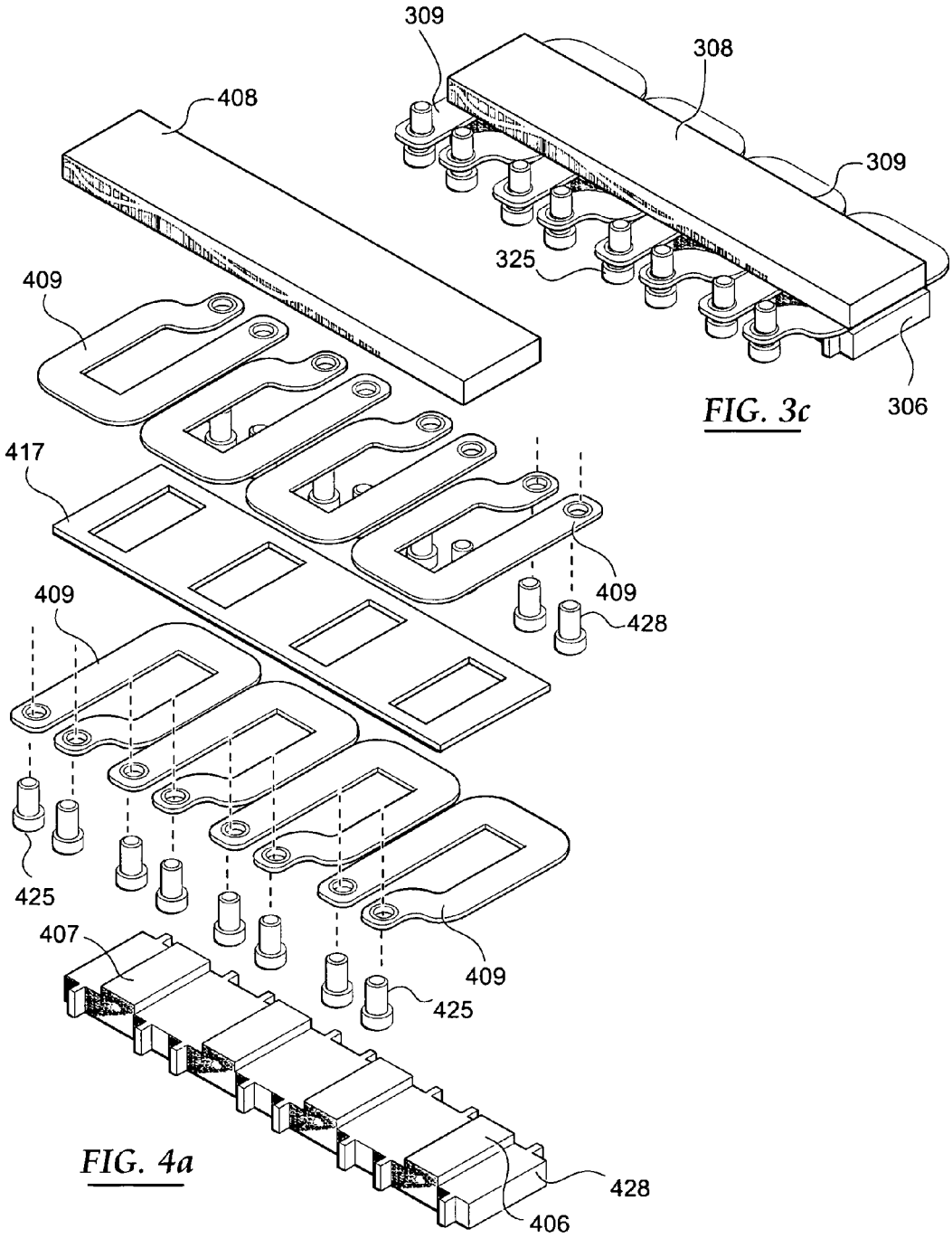
FIG. 3*c* is a top perspective view of the device of FIG. 3*a* shown fully assembled.
FIG. 4*a* is a top perspective exploded view of still another exemplary embodiment of the improved inductive device of the present invention.

FIGS. 3*a*-3*c* illustrate yet another exemplary embodiment of the improved inductive device 300 of the present invention. In this device 300, the substrate 221 with winding traces of the device 200 of FIG. 2 is replaced with a set of juxtaposed flat "loop" windings 309. These windings are structured so as to lay substantially flat on the central core element 306, around respective ones of the risers 307 of the core 306. Each winding loop 309 is configured with a set of terminal apertures 322 into which terminal pins 325 of the type previously described are fit; however, it will be appreciated that literally any type of electrical interface may be used with such windings 309 including, e.g., providing each winding with a distal portion (not shown) akin to the contact pads of the windings embodiment of FIG. 1*a* above. As with the other embodiments, a residue gap may optionally be used, and the windings can also be sized and placed relative to the core risers 307 such that the gap flux interaction is mitigated.

Figure 4B:
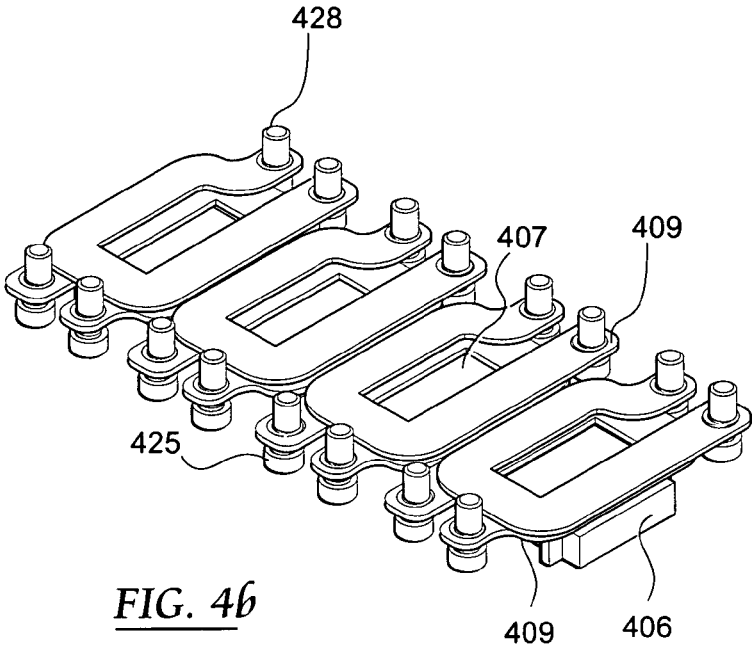
FIG. 4*b* is a top perspective view of the device of FIG. 4*a* shown partially assembled.
Figure 4C:
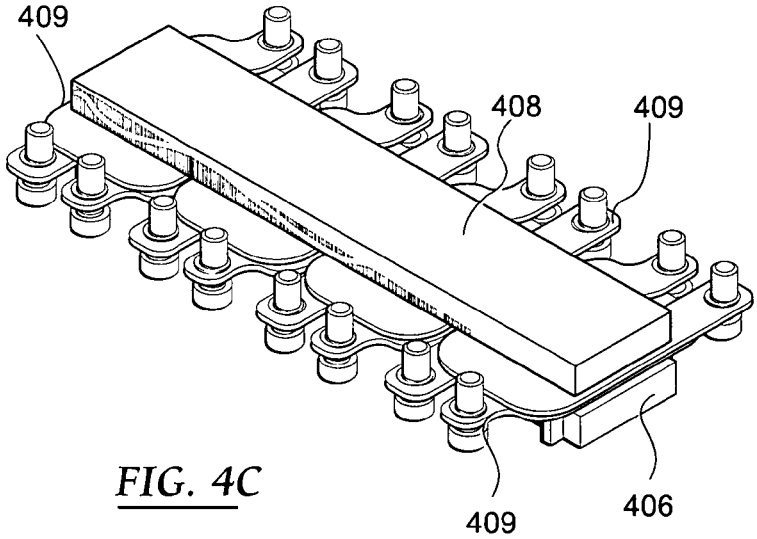
FIG. 4*c* is a top perspective view of the device of FIG. 4*a* shown fully assembled.

FIGS. 4*a*-4*c* illustrate still another exemplary embodiment of the inductive device 400 of the invention, having multiple (e.g., two) sets of juxtaposed yet rotated windings 409 disposed within a common core 406 with risers 407. The two sets of windings 409 are offset in the vertical plane from one another, and separated by an insulating material. In one embodiment, this insulating material comprises several small thin sheets of an insulator 417 such as Kapton polyimide or the like disposed between the different sets of windings 409. These sheets can be cut as shown so as to fit around the risers 407, or alternatively may simply lay atop the windings in-between the risers.

In another embodiment, a spray-on coating or tape is used on at least a portion of the windings 409 to provide the desired separation. Note that the windings may also be pre-insulated at time of manufacture, such as via dip or spray coating, or tape winding. However, the use of insulating sheets (e.g., Kapton) generally provides the best uniformity at comparatively low cost.

The embodiment of FIG. 4*a*, much like those of FIGS. 1*a* and 2*a*, has the advantage of lateral stability and planarity, since the two sets of windings 409 have terminals offset on different (opposing) sides of the core 406.

FIGS. 5*a* and 5*b* are top perspective views of yet other exemplary embodiments of inductive devices according to the invention, each of the cores of these devices having a heterogeneous riser configuration. Specifically, as previously discussed, the two end inductors in a multi-inductor device such as that of FIGS. 5*a* and 5*b* necessarily have different inductive properties (i.e., less inductance at a given frequency) than the inboard inductors due to the "open" ends of the magnetic loops of these inductors. As is well known in the electronic arts, the inductance L of such devices (in general) is given by the relationship of Eqn. (1):

$$L=N^2/R \qquad \text{Eqn. (1)}$$

Where:

L=inductance;

N=number of turns; and

R=reluctance

Reluctance can be expressed by the relationship of Eqn. (2):

$$R=l/\mu A \qquad \text{Eqn. (2)}$$

Where:

l=path length;

μ=permeability; and

A=area.

Hence:

$$L=\mu AN^{-2}/l \quad \text{Eqn. (3)}$$

Accordingly, the configurations of FIGS. 5*a* and 5*b* make use of Eqn. (3) by controlling, inter alia, the area (A) of the gap region of the core 506. By increasing area of the risers 507 of the two end inductors 511, 512, their inductance can be increased and brought to the same approximate level of the inboard inductors, thereby allowing for a level of inductance balancing not achievable under the prior art. When combined with the use of residue gap and winding/gap displacement as previously described herein, a device having extremely well-balanced and precise inductances results. However, it will be recognized that this approach can be combined with or used in each of the embodiments described herein; i.e., with or without residue gap, winding location away from the gap, Kapton film or not, and so forth.

It will also be appreciated that the size of the gap used on the end inductors can be varied as desired (with or without the use of the heterogeneous riser area as in FIGS. 5*a* and 5*b*) in order to further control the magnetic properties of these devices. For example, in the variant of FIG. 5*a*, all four inductors have the same gap, and a common sheet 517 of gap material (e.g., 0.001 in. Kapton sheet) is used between all inductors. However, in the embodiment of FIG. 5*b*, the two "end" inductors 511, 512 of the device have smaller gaps than the inner two inductors, and hence the latter use a thicker (e.g., 0.002 in.) Kapton sheet. It will be appreciated that these dimensions are only illustrative, and hence should not be considered in any way limiting.

Furthermore, control of the path length or area is not limited to the gap surfaces. Hence, by altering the physical properties (e.g., path length or cross-sectional area) of other portions of the magnetic path, the inductance of the end (or inner) inductors can be controlled. For example, by varying the spacing between the inner and outer risers 507 (i.e., adjusting the length of the core 506 along the longitudinal dimension at certain points between the inner and outer inductors), the path length can be increased, and inductance reduced. Similarly, by varying the cross-sectional area of the core in these regions, inductance can also be controlled. Hence, the present invention contemplates the use of potentially several variables (including, e.g., gap size and area, inter-inductor path length, interposed gap material, residue, etc.) to fine-tune each inductor in order to produce the optimal level of performance.

Referring now to FIG. 6, yet another embodiment of the inductive device of the present invention is described. As shown in FIG. 6, the device 600 comprises a substantially longitudinal central core element 606 that includes a plurality of inductors. The windings (not shown) are disposed within channels 610 formed between the core element risers 607 as in the previous embodiments. However, the core element 606 of FIG. 6 has a modified configuration at its ends 617, 619 somewhat akin to a prior art "E" core, wherein the outermost risers 607*a*, 607*b* comprise the ends of the core 606 (as opposed to having "open" ends of the type previously described. This approach allows for less magnetic flux leakage out the ends of the core, thereby providing greater uniformity in inductance between the inductors disposed at the ends of the core element 606 and those interior on the core.

It will also be recognized that while the embodiment of FIG. 6 shows risers 607 having the same height and general dimensions (including gap surface area A), various of the previously described features may be used consistent with this core shape, whether alone or in various combinations. For example, in one variant, the two end risers 607*a*, 607*b* are made to have a grater surface area A than the rest of the risers, as discussed above with respect to FIGS. 5*a* and 5*b*. In another variant, the interior risers 607*c*, 607*d*, 607*e* are made to be lower in height than the outer risers 607*a*, 607*b*, thereby creating a larger gap for these devices. The outer device gaps may comprise a residue gap, while the inner devices utilize a Kapton or similar spacing material. Also, the length of the core between individual risers can be adjusted (as well as other properties of the magnetic path for each inductor) as previously described. Hence, the present invention contemplates the utilization of one or more of the foregoing features to achieve a desired design objective (e.g., maximal uniformity of inductance between the individual inductors on the device 600).

The embodiment of FIG. 6 (as well as other embodiments described herein) may also include one or more clip or retainer recesses 630 as shown in FIG. 6. These may be used to, for example, receive and retain a metallic or other spring clip or mating device of the type well known in the art (not shown) which keeps the various components of the device 600 together in a prescribed relationship, with or without other corresponding methods (such as adhesives or thermal bonding to Kapton). This (clip, etc.) approach has the advantage of simplicity, especially when used alone, since the assembler merely needs to properly position the various components of the device 600 and apply the clip(s) so as to complete the assembly of the device.

Method of Manufacture

Figure 7:
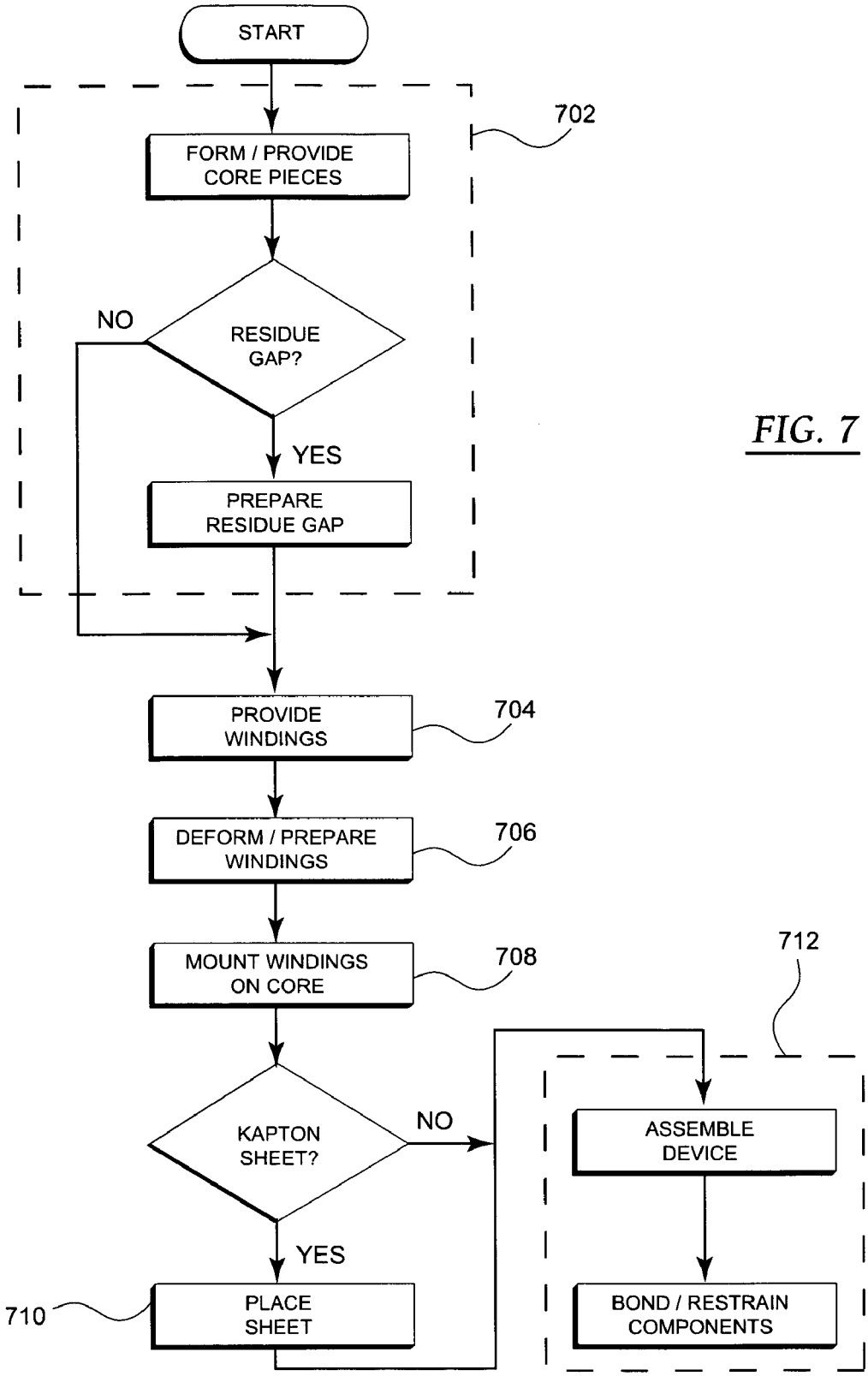
FIG. 7 is logical flow diagram of an exemplary embodiment of the method of manufacturing the inductive device(s) of the invention.

Referring now to FIG. 7, an exemplary embodiment of the method 700 for manufacturing the present invention is now described in detail.

It will be recognized that while the following description is cast in terms of the device 100 of FIG. 1, the method is generally applicable to the various other configurations and embodiments of inductive device disclosed herein with proper adaptation, such adaptation being within the possession of those of ordinary skill in the electrical device manufacturing field.

In a first step 702 of the method 700, one or more central core elements 106 are provided. The cores may be obtained by purchasing them from an external entity or can involve fabricating the cores directly. Top pieces 108 are also provided or fabricated. The core components 106, 108 of the exemplary inductor described above is preferably formed from a magnetically permeable material (e.g., Manganese-Zinc or Nickel-Zinc mixed with other materials) using any number of well understood processes such as pressing or sintering. The core is produced to have specified material-dependent magnetic flux properties, cross-sectional shape, riser dimensions, residue, etc. as previously described herein.

As noted above, the core components 106, 108 may also be cut or otherwise machined from a ferrite block, with the selected number (e.g., 1 or 2 or 4) of risers. Hence, a generic core blank can be used if desired and be cut down as needed.

Also included within step 702 is any required preparation of the gap surfaces in order to provide the desired residue as previously described herein. For example, in one embodiment, the riser 107 gap surface is micro-polished in order to provide a given surface texture or roughness.

Next, one or more windings are provided (step 704). The windings are preferably copper-based and substantially flat in profile as discussed above (see FIG. 1*a*), although other types of conductors may be used.

Where uniform inductances are desired, each of the windings are made as identical as possible. Alternatively, where different inductance values or other properties are desired, the windings may be heterogeneous in shape, thickness, length, and/or constituent material.

Per step 706, the windings are next deformed (e.g., bent or stamped) into the desired shape before being placed onto the core, although this is not required in that the windings may alternatively be placed on the core with at least portions of the windings deformed thereafter. However, pre-forming of the windings tends to simplify the manufacturing process as will be readily apparent.

Next, per step 708, each winding is restrained on the central core 106, with the contact portion adapted for surface mounting to a PCB or other device. The windings 109 may be bonded to the core 106 using an adhesive, encapsulant or epoxy, or using other bonding process such as fusion of the winding metal to the ferrite core using a brazing or similar process. A eutectic may also be employed to restrain the windings 109 in place.

As yet another alternative, the windings 109 can be sized and configured (e.g., with a very slight taper on the vertical sections of each winding that abut the sides of the central core 106 such that the windings are somewhat "spring loaded" against the core sides) such that they are frictionally retained on the core, either alone or in conjunction with other means. Similarly, surface features formed on various portions of the core 106 can be used to capture or frictionally retain the windings 109 on the core 106.

As still another alternative, the top piece 108 can be used to capture the windings 109 between itself and the central core 106, such as where the height of the risers 107 is set to approximately correspond to the winding thickness.

If any intermediary material (such as for example Kapton polyimide sheeting or the like) is to be interposed between the central core element 106 and the top piece 108, it is positioned (and optionally bonded) as necessary per step 710.

Lastly, per step 712, the top piece 108 is disposed onto the device central core 106 and mated thereto (whether bonded via adhesive or Kapton sheet, held in place using an external clip, etc.), thereby completing the device assembly.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. For example, while the invention has been disclosed in terms of a component for telecommunications and networking applications, the inductive device architecture of the present invention could be used in other applications such as specialized power transformers. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A precision inductive device comprising:

a core base element having a plurality of inductors each adapted to receive at least one winding, said inductors each comprising a riser; and a core cap element;

wherein said cap element cooperates with at least one of said risers to form a residue gaps said residue gap comprising at least one microscopically coarse surface on at least one of said core base element and said core cap element.

2. The inductive device of claim 1, wherein said at least one winding is disposed substantially at the bottom of a channel formed between adjacent ones of said risers, such that said at least one winding and said residue gap are at different elevations within said inductive device.

3. The inductive device of claim 2, wherein said at least one winding comprises a plurality of substantially U-shaped windings each having a substantially rectangular cross-section and adapted for surface-mounting to a circuit board or other substrate.

4. The inductive device of claim 1, further comprising a polyimide film disposed between at least portions of said core cap element and core base element.

5. The inductive device of claim 1, wherein said plurality of inductors comprises two end inductors and at least one other inductor, said end inductors having at least one different magnetic path characteristic than said at least one other inductor.

6. The inductive device of claim 5, wherein said different magnetic path characteristic comprises a different gap cross-sectional area.

7. A coupled inductive device comprising:

a core base element having a plurality of inductors disposed in substantially juxtaposed orientation and each adapted to receive at least one winding, said inductors each comprising at least one riser; and a core cap element;

wherein said cap element cooperates with at least one of said risers and at least one coarse textured surface on said cap element or said at least one of said risers to form a residue gap; and wherein said at least one winding is disposed substantially at the bottom of a channel formed between adjacent ones of said risers, such that said at least one winding and said gap are at different elevations within said inductive device.

8. The coupled inductor device of claim 7, wherein said gap comprises a residue gap.

9. The coupled inductor device of claim 7, wherein said different elevations reduces eddy current formation in at least portions of said inductive device.

10. A coupled inductor device comprising a plurality of inductors formed in a side-by-side disposition within a core having first and second ends and a cap element, two of said inductors being disposed on respective ones of said first and second ends, said two end inductors having different magnetic path characteristics than the others of said plurality of inductors so as to cause all of said plurality of inductors within said device to have substantially identical inductance values.

11. The coupled inductor device of claim 10, wherein said core comprises a monolithic base element, said base element having a plurality of risers and forming a gap with said cap element, and further comprising a plurality of windings disposed substantially at the bottom of a channel formed between adjacent ones of said risers, such that said windings and said gap are at different elevations within said inductive device so as to mitigate eddy currents within said core.

12. An inductive device comprising:

a substantially elongated core base element having a plurality of inductors in juxtaposition and each adapted to receive at least one winding, said inductors each comprising a riser; and a core cap element;

wherein said cap element attaches with at least one of said risers to form a residue gap for each of said inductors, said residue gap comprising at least one microscopically coarse surface on said core base element and/or said core cap element.

13. The inductive device of claim 12, wherein said at least one winding is disposed substantially at the bottom of a channel formed between adjacent ones of said risers, such that said at least one winding and said gap are at different elevations within said inductive device.

14. The inductive device of claim 12, further comprising a polyimide film disposed between at least portions of said core cap element and core base element.

15. The inductive device of claim 13, wherein said at least one winding comprises a plurality of substantially U-shaped windings each having a substantially rectangular cross-section and adapted for surface-mounting to a circuit board or other substrate.

16. The inductive device of claim 12, wherein said plurality of inductors comprises two end inductors and at least one other inductor, said end inductors having at least one different magnetic path characteristic than said at least one other inductor.

17. The inductive device of claim 16, wherein said different magnetic path characteristic comprises a different gap cross-sectional area.

18. A coupled inductor device comprising a plurality of inductors formed in a side-by-side disposition within a core having first and second ends, said device further comprising:

a cap element adapted to substantially mate with at least portions of said core, and form a gap having at least one substantially textured surface therewith, said at least one substantially textured surface comprising an array of micro-gaps; and a plurality of windings;

wherein two of said inductors are disposed on respective ones of said first and second ends, said two inductors having different magnetic path characteristics than the others of said plurality of inductors.

19. The coupled inductor device of claim 18, wherein said core comprises a monolithic base element, said base element having a plurality of risers and forming said gap with said cap element, and wherein said windings are disposed substantially at the bottom of respective channels formed between adjacent ones of said risers, such that said windings and said gap are at different elevations within said inductive device so as to mitigate eddy currents within said core.

20. The coupled inductor device of claim 18, wherein said windings each comprise a substantially U-shaped winding having a substantially rectangular cross-section and adapted for surface-mounting to a circuit board or other substrate.

21. The inductive device of claim 18, wherein said different magnetic path characteristic comprises a different gap cross-sectional area.

* * * * *